US006106623A

United States Patent [19]

Nishikawa

[11] Patent Number: 6,106,623

[45] Date of Patent: Aug. 22, 2000

[54] PRINTED SHEET COATING APPARATUS

[75] Inventor: Masaji Nishikawa, Hachioji, Japan

[73] Assignee: Olympus Optical Co., Ltd., Tokyo, Japan

[21] Appl. No.: 09/013,706

[22] Filed: Jan. 26, 1998

[30] Foreign Application Priority Data

Jan. 28, 1997 [JP] Japan ..... 9-014038

[51] Int. Cl.[7] ..... B05C 5/00

[52] U.S. Cl. ..... 118/673; 118/679; 118/315; 118/323; 101/416.1; 101/419; 101/424.2

[58] Field of Search ..... 118/673, 679, 118/323, 315; 427/416, 421, 424; 347/101; 101/416.1, 417, 419, 424.2; 156/277, 387; 239/102.2, 102.1

[56] References Cited

U.S. PATENT DOCUMENTS

| | | | |
|---|---|---|---|
| 3,257,226 | 6/1966 | Thwaites | 427/421 |
| 3,927,226 | 12/1975 | Kadona et al. | 427/140 |
| 4,724,025 | 2/1988 | Nishikawa | 156/230 |
| 4,807,528 | 2/1989 | Schmoeger et al. | 101/424.2 |
| 5,324,359 | 6/1994 | Cleveland et al. | 118/323 |
| 5,460,653 | 10/1995 | Otani et al. | 118/324 |
| 5,518,179 | 5/1996 | Humberstone | 239/102.2 |

FOREIGN PATENT DOCUMENTS

| | | |
|---|---|---|
| 61-47284 | 3/1986 | Japan . |
| 62-101482 | 5/1987 | Japan . |
| 7-501481 | 2/1995 | Japan . |
| 7-299901 | 11/1995 | Japan . |

*Primary Examiner*—Laura Edwards

*Attorney, Agent, or Firm*—Frishauf, Holtz, Goodman, Langer & Chick, P.C.

[57] ABSTRACT

In order to prevent a coating liquid from scattering outside the surface of a printed sheet, an on-demand coating head having plural jet sections is arranged along a direction parallel to the left and right edges of the printed medium, and jets only liquid droplets along a predetermined direction by vibration of a piezoelectric vibrator plate and a coating area with a width extending along a direction parallel to the edges of the printed medium. That is, the head is in a reciprocating manner moved on the printed medium along a direction perpendicular to a direction of arrangement of the jet sections, and the head is in a relative manner moved on the printed medium along a direction perpendicular to the above moving direction by a secondary coating scanning control circuit. Edge position signals are produced which respectively indicate an edge position of an effective image in the primary coating scanning direction of the printed medium, and an edge position of the printed medium and jet of liquid droplets from the on-demand control coating head and a reciprocal movement thereof are controlled based on the edge position signals.

15 Claims, 8 Drawing Sheets

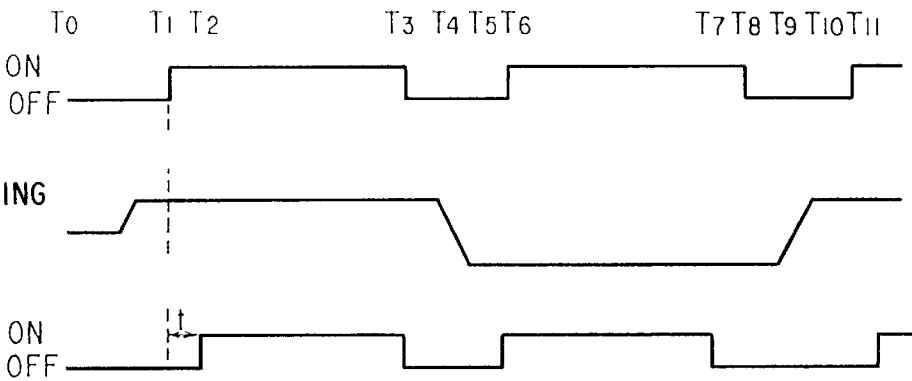
FIG. 3A
FIG. 3B
FIG. 3C
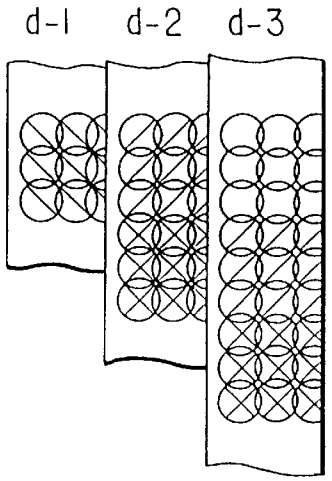
FIG. 4D
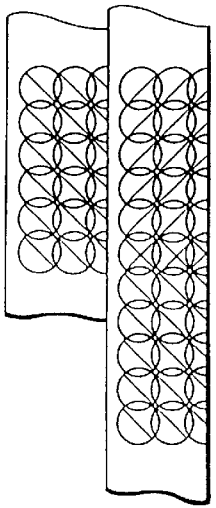
FIG. 4C
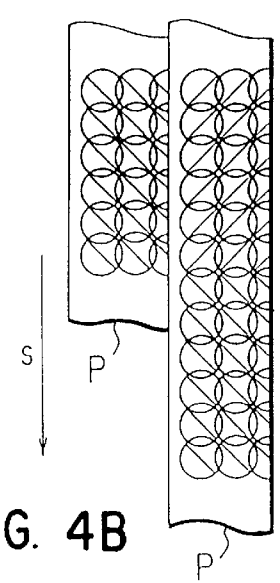
FIG. 4B
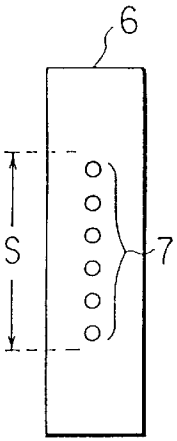
FIG. 4A

PRINTED SHEET COATING APPARATUS

BACKGROUND OF THE INVENTION

The present invention relates to an apparatus for applying a coating liquid on the surface of a medium already printed and more particularly, a printed sheet coating apparatus, which prevents a coating liquid from scattering outside a printed sheet, and which can correctly control a coating area.

Conventionally, printers based on various principles have been put into practical use as simple and easy means for forming a printed image on various printing media such as a paper sheet, a plastic sheet and cloth. Especially, there have been well known and widely accepted printers in practical aspects, which can print a color image and in addition form that of large size with simplicity and ease, which are: an ink jet printer using a liquid ink, a solid-ink ink jet printer using a hot melt ink, a thermal printer using a wax-ink ribbon and a thermal printer using a sublimation dye ribbon and a color electrostatic printer using a liquid developer.

While these printers can produce a printed image with simplicity and speediness, there have been a fault of poverty in various kinds of resistance in the image. That is, one has no water resistance of its colored material in an image and in addition no water resistance of its coated recording layer which is formed on a recording medium. Another one has a small resistance to surface injury on its image and thereby the image is subject to scratches. A still another one is that a colored material is chemically unstable and thereby the color thereof is faded away by a finger print. In general, printed images obtained by the printers have had poor light resistance and has been easy to fade away.

In order to complement such faults, there has been proposed a technique in which an image is protected by a transparent laminated film adhering to the image surface. However, since a laminated film is expensive and the image surface is covered with a thick plastic sheet, a feeling of the surface is conspicuously changed. Moreover, an expensive, large scaled apparatus is required for lamination and it demands an expertise in correctly performing the lamination in the case of a large image.

There has been proposed another technique in, for example Publication of Jpn. Pat. Appln. KOKAI Publication No. 62-101482, in which a transparent hot melt coating is applied on the surface of a printed image. This method has a smaller change in feeling of the print surface than the lamination. However, there is a need for a special ribbon and an special apparatus for the coating, which causes high cost, and besides, there is a restriction that the surface which receives the coating must have a good flatness.

As means, which does not accompany such faults or restrictions as described above, there has been presented a technique in U.S. Pat. No. 4,724,025 assigned to the same applicant as that of the present application in which spray coating is applied on a printed image. According to the technique, coating in use for various objects can be achieved by selection of a coating liquid and besides not only does no problem happen even if a surface has a concavity and convexity profile thereon, but also a change in feeling of a printed surface can be suppressed to a minimum level. A structure of a printing apparatus in which a coating apparatus shown in the above mentioned U.S. Pat. No. 4,724,025 is incorporated is shown in FIG. 17 and the structure will be described.

In FIG. 17, a scanning drum 206 holds a print sheet on its outer circumferential surface in a winding manner. A reference mark 203 indicates an ink jet print head, reference marks 204, 205 indicate a guide rail and a feed screw for secondary scanning. A reference mark 217 indicates a spray device, which comprises a spray gun 218 and a coating liquid tank 219, and which moves on guide rails 220. Printing is performed by rotation of the drum 206 and the coating liquid is applied by being jet with the spray gun 218 on the printed medium which has been finished with printing. As coating means, a spray gun with which a coating liquid is sprayed together with compressed air, a device with which a mist is produced by an ultrasonic vibrator or the like is used.

However, with the coating apparatus employing a spray head according to the conventional techniques, which is used for coating on a printed sheet, there has been a fault that a coating liquid is scattered beyond the periphery and thereby the surroundings are greatly contaminated since a flying direction of the coating liquid is not fixed. Therefore, while there is no problem when the small number of printed media are treated by hand coating or when coating is carried out in a spray booth equipped with a suction duct of exclusive use, the apparatus cannot be used in an office room or in a place indoors where no special facilities are provided and in these cases loss of the coating liquid have been tremendous.

While in the cases where a conventional lamination film or a hot melt coating material is subjected to transfer coating, coating can be achieved at a constant thickness all the time regardless of a feed rate of a printed medium, in the case of a spray coating method a thickness of coating has been fluctuated in dependence on a change in the feed rate of the printed medium.

In a conventional spray coating method, since a boundary of a spraying area is vague, some of a coating liquid which flies outside the boundary contaminates transportation means and the like attaching thereto if coating is conducted so as to cover a boundary area, which has been an obstacle for realization of a coating apparatus for a printed sheet.

Further, in the case where lamination or coating is conducted on a printed sheet different in width by a conventional technique, changes in specification of necessary materials and setting greatly different operational conditions have been required and thereby surface protection freely corresponding to different widths of various media has not been realized with ease.

Moreover, according to a conventional technique, in the cases where a kind of lamination or coating is changed, a preceding large scale preparation is required and thereby a change in kind of lamination or the like with a small amount as a unit has not been able to be conducted with ease.

BRIEF SUMMARY OF THE INVENTION

The present invention has been made in light of the above problems and it is an object of the present invention to provide a technique in which a coating liquid is prevented from being scattered outside the surface of a printed sheet, a predetermined thickness of coating can be secured following a feed rate of a printed medium, a coating area can easily or automatically adjusted in a freely corresponding manner on a printed sheet, whose width or the width of a printed area on which is different in a various way and a coating material having different action and effect can easily selected for the use, whereby unnecessary consumption of the coating liquid is prevented.

In order to achieve the above mentioned object, according to a first embodiment of the present invention, there is provided a coating apparatus for a printed sheet in which a coating material in a liquid state is applied on a medium already printed, which comprises: an on-demand coating head, which has plural jet sections arranged in a direction parallel to the left and right side edges of the printed medium, which jets only liquid droplets along a predetermined direction from the respective jet sections by vibration of a high frequency vibrator element, and which produces a coating area having a width extended in the direction parallel the edges; primary coating scanning means reciprocating the on-demand head on the printed medium along a direction crossing the edges; secondary coating scanning means for moving the on-demand coating head and the printed medium along a direction perpendicular to the edge crossing direction in a relative manner; signal producing means for producing an edge position signal indicating at least one of an effective image edge position and a printed medium edge position in the primary coating scanning direction on the printed medium; and coating control means for controlling at least one of liquid droplet jet from the on-demand coating head and a reciprocating movement of the on-demand coating head based on the edge position signals.

According to a second embodiment of the present invention, there is provided a coating apparatus for a printed sheet of an integrated-in printer type in which a coating liquid is applied on the surface of a medium already printed discharged from a printing section, which comprises: an on-demand coating head, which has plural jet sections arranged in a direction parallel to a discharging direction of the printed sheet, which jets only liquid droplets limiting a direction from the respective jet sections by vibration of a high frequency vibrator element, and which produces a coating area having a width extended in the direction parallel the edges; primary coating scanning means reciprocating the on-demand head while traversing the printed medium along a direction crossing the edges; signal producing means for producing an edge position signal indicating at least one of an effective image edge position and a printed medium edge position in the primary coating scanning direction on the printed medium; and control means for controlling at least one of a liquid droplet jet from the on-demand coating head and a reciprocating movement of the on-demand coating head based on the edge position signal or signals.

According to a third embodiment of the present invention, there is provided a coating apparatus for a printed sheet for applying a coating material in a liquid state on the surface of a printed medium, which comprises: a page-wide coating head unit mounted so as to correspond to the maximum width of the printed medium along a direction perpendicular to a feed direction of the printed material; a coating head unit, in which an on-demand coating head is disposed so as to traverse the printed medium in a width direction in such a structure that the printed medium is divided in plural sections, wherein there is provided a structure in which control can be made with a section as a unit, the on-demand coating head having plural jet sections, jetting only liquid droplets limiting a direction from the respective jet sections by vibration of a high frequency vibrator element, and producing a coating area in the shape of a band extended in a direction perpendicular to the feed direction of the medium; signal producing means for producing an edge position signal indicating an edge position along an arrangement direction of the sections; and control means for controlling the on-demand coating head of the page-wide coating head with a section as a unit based on the edge position signal and a signal indicating feed of the printed medium.

Additional object and advantages of the invention will be set forth in the description which follows, and in part will be obvious from the description, or may be learned by practice of the invention. The object and advantages of the invention may be realized and obtained by means of the instrumentalities and combinations particularly pointed out the appended claims.

BRIEF DESCRIPTION OF THE SEVERAL VIEWS OF THE DRAWING

The accompanying drawings, which are incorporated in and constitute a part of the specification, illustrate presently preferred embodiments of the invention and, together with the general description given above and the detailed description of the preferred embodiments given below, serve to explain the principles of the invention.

FIG. 3A is a timing chart showing ON/OFF control of a edge sensor,

FIG. 3B is a timing chart showing control of reciprocating movement and stoppage in primary coating scanning and FIG. 3C is a timing chart showing ON/OFF control of a coating head;

FIG. 4A is a view showing a state of a on-demand coating head 6,

FIG. 4B is a view illustrating an example of a coating operation,

FIG. 4C is a view illustrating an example of the coating operation and

FIG. 4D is a view illustrating an example of the coating operation;

DETAILED DESCRIPTION OF THE INVENTION

Embodiments of the present invention will below be described in reference to the accompanying drawings.

Figure 1A:
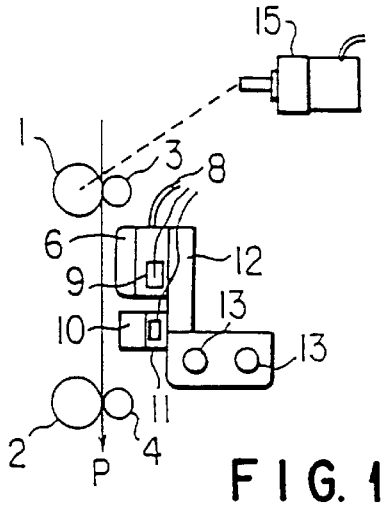
FIG. 1A is a side view showing a structure of a printed sheet coating apparatus according to a first embodiment of the present invention.
Figure 1C:
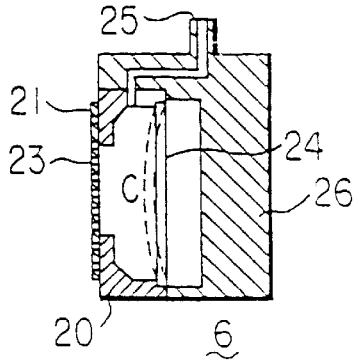
FIG. 1B is a front view showing the structure of a printed sheet coating apparatus and FIG. 1C is a detailed view showing an example of an on-demand coating head.
Figure 1B:
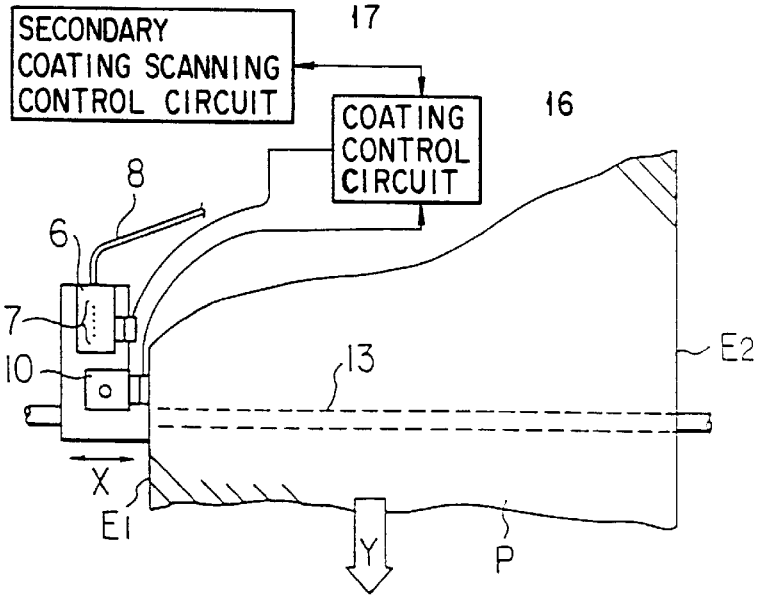

FIGS. 1A, 1B are the views showing a structure of a printed sheet coating apparatus according to a first embodiment of the present invention, FIG. 1A is the side view of the apparatus, FIG. 1B is the front view thereof, and FIG. 1C is the detailed view showing an example of an on-demand coating head.

In FIGS. 1A, 1B, a mark P indicates a printing medium already printed, an arrow depicted in the figure indicates a feed direction of the printing medium and marks E1, E2 respectively indicate edges of the printing medium P. The printing medium P is transported being held by a feed roller 1, 2 and a pressure roller 3, 4.

The on-demand coating head 6 is disposed at a position opposed to a printing surface of the printing medium P and plural jet sections 7 are provided along a direction parallel to the edges E1, E2. A supply tube 8 for supplying a coating liquid and a connector 9 for supplying electricity are both connected to the on-demand coating head 6. An edge sensor 10 for detecting the edges of the printing medium P are located at a position opposed to the surface plane of the printing medium P and the edge sensor 10 is provided with a connector 11 for supplying electricity.

The on-demand coating head 6 and the edge sensor 10 are held by a movable table 12 and the movable table 12 is supported by a drive means, not shown, so as to be able to move on guide rails. A movable range of the on-demand coating head 6 and the like is preferably larger than at least the width of the printing medium P in order that coating is conducted with certainty. In addition, a feed motor 15 is provided to give a driving force to the feed roller 1.

A coating control circuit 16 performs not only jet control of the coating head 6 but control of a secondary coating scanning control circuit 17 by receiving a signal of the edge sensor 10. Alternately, the coating control circuit 16 performs jet control of the on-demand coating head 6 by receiving a signal from a secondary coating scanning control circuit 17.

The on-demand coating head 6 applied to the present invention herein can adopt a structure, which has plural jet sections, which can jet only liquid particles limiting a direction from the respective jet sections by vibration of a high frequency vibrator, and which can produce a coating area having a width extended in the direction parallel the edges.

The on-demand coating head 6 shown in FIG. 1C comprises a coating liquid room C, the coating liquid room C further comprises a piezoelectric vibrator plate 24, an orifice plate 21 and a side wall 20 and the coating liquid room C is supported by a support 26. Besides, the coating liquid room C is communicated to a feed tube 8 through a feed opening 25 mounted on a support 26. The orifice plate 21 has plural openings 23 arranged in a linear fashion with a single or plural rows.

The piezoelectric vibrator plate 24 which is a high frequency vibrator element is in advance given a polarization and electrodes are mounted on both sides thereof. In this embodiment, there is adopted a structure in which a deformation which is shown by a broken line in the figure arises with a selection of combinations of a polarization direction and an application direction of a voltage or with adoption of a bimorphic structure in which a piezoelectric vibrator plate 24 and a non-field-response plate are combined.

The piezoelectric vibrator plate 24 is deformed instantly after application of a voltage, thereby a pressure in the coating liquid room C is raised and the coating liquid is thus jet through the openings 23 of the orifice plate 21. If a voltage applied on the piezoelectric vibrator plate 24 is a high frequency pulse or an alternating voltage, jet of the coating liquid is repeated at a high speed and a function of the coating head is thus exerted. The coating liquid is supplied from the feed opening 25 through the supply tube 8. The coating liquid is jet from the orifice plate 21 through the openings 23 in directions perpendicular to the orifice plate 21 so as to have a flying direction of the jet limited and to give the jet liquid a strong directionality, so that an impinging position is correctly determined.

Switching between ON/OFF states of the jet of the coating liquid are controllable at a very high speed by ON/OFF operations in voltage application on the piezoelectric vibrator plate 24. A vibration cycle of the piezoelectric vibrator plate 24 is preferably set in the range of hundreds to thousands of Hz and a diameter of a coating liquid droplet is preferably set in the range of several to hundreds of $\mu$m. If a value of an applied voltage on the piezoelectric vibrator plate 24 is changed, a jet rate of coating liquid can be controlled and if a frequency is changed a jet rate of coating liquid can also be controlled. Definite forms and sizes are design parameters determined by a viscosity of a coating liquid and a required jet rate.

Another structure of an on-demand coating head 6 which can preferably applied to the first embodiment shown in FIG. 2A will be described.

Figure 2B:
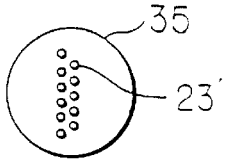
FIG. 2A is a view showing another structure of an on-demand coating head 6 which can preferably applied to the first embodiment and FIG. 2B is a view showing states of openings of a porous film.
Figure 2A:
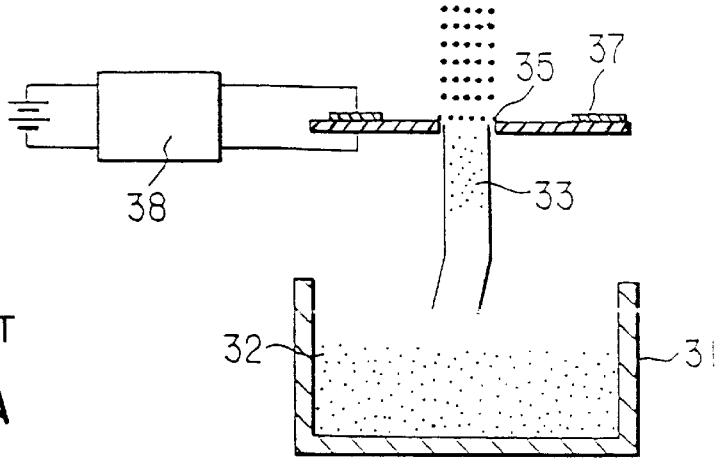
PRIOR ART FIG. 2A

In FIG. 2A, a liquid vessel 31 contains a liquid 32, the liquid 32 is supplied to a porous film 35 through a capillary tube 33. A piezoelectric vibrator plate 37 as vibration means vibrates by application of a voltage from a high frequency power supply 38 and the liquid 32 is sprayed in high speed streams composed of droplets from opening 23' of the porous film 35. Such an on-demand coating head is preferred to apply coating limiting an area since liquid droplets are jet from positions of the openings of the porous film and besides jet directions are controlled so as to align the axial directions of the openings.

A size of a droplet can be prepared in the range of a minute one of submicrons to a large diameter one of hundreds of microns by setting, but in application to the first embodiment, if droplets each of which is a minute one of submicrons are used, flying directions of the droplets are irregularly disordered with ease and thereby droplets of the order of microns or larger are used to limit flying directions.

The porous film 35 is constituted as shown in FIG. 2B so that a band like area having a sharp boundary, aligned with an arrangement of the openings 23', is produced by arranging the openings 23' in a single row or plural rows.

Operations of the printed sheet coating apparatus according to the first embodiment having such a structure as described above.

The feed roller 1 is rotated by a rotation of the feed motor 15 controlled by the secondary coating scanning control circuit 17 and thereby a printing medium P already printed is transported along a Y direction marked by an arrow. A way of this transportation may be either continuously or stepwise effected. When a signal of the secondary coating scanning control circuit 17 is also transmitted to the coating control circuit 16, a motor, not shown, is driven to rotate by a direction of the coating control circuit 16 and thereby the movable table 12 is moved to make the primary coating scanning started.

When the movable table 12 is moved along an X direction traversing the printed medium P from a position shown in the figure, the edge sensor 10 detects an edge E1 of the printed medium P and the coating control circuit 16 controls in such a manner that the on-demand coating head 6 enters an on state after the coating head 6 passes over the edge E1 portion at a time a little later than the detection of the edge E1.

At a time point when the movable table 12 passes over the other edge E2 of the printed medium P, the edge sensor 10 first detects the edge E2 and the coating control circuit 16 gives a direction to control and bring coating to an off state before a coating position of the on-demand coating head 6 passes over the edge E2.

In the case where coating is conducted in a return pass of the primary coating scanning, the positions of the edges E1, E2 are memorized and the coating control circuit 16 is constituted so as to control by the stored information of the positions. Alternately, it is allowable that a second edge sensor is disposed in addition on the other side across the jet sections of the coating head from the edge sensor 10 and thereby primary coating scannings in forward and backward travels are both utilized by control in which sensor signals in both primary scanning travels are switched.

In one primary coating scanning, there is produced a coating area in the shape of a narrow and elongated band with a width in the feed direction of the printed medium covered by the plural jet sections 7. Therefore, the coating scanning is controlled by the coating control circuit 16 so that a feed in the Y direction of the printed medium and a coating width are coincide with each other. Alternately, a secondary coating scanning is set so that a feed of the secondary coating scanning may match with the coating scanning.

In order to effect the coating in such a manner as mentioned above, the on-demand coating head 6 is required to be a head which can be controlled in terms of ON/OFF control at a high speed by a command. At the same time, it is required that a flying direction of a jet stream is restricted in order that coating droplets adhere to a desired area only of the surface of the printed medium and do not contaminate an area outside the desired area by being scattered and floating away, and in response to such a requirement, it is required in the on-demand coating head 6 that a piezoelectric vibrator plate which is a high frequency vibrator element is adopted, that with the vibrator plate, only liquid droplets, whose flying direction are controlled in a predetermined direction, and which are sprayed from specified jet sections are jet, and that the liquid droplets are not accompanied with compressed air.

Production of a signal indicating an edge position of the printed medium P is not limited to the edge sensor 10 shown in the figure but needless to say that setting can be effected by input from, for example, an operation panel, which is means for inputting a designated position by a manual operation, or mechanical means such as a designated slide scale.

A coating area by the on-demand coating head 6 can be set based on an effective image area of a printing image differently from the edges of the printed medium. In the case where the effective image area is adopted, designation of a position may be conducted by designating the position by a distance from an edge of the printed medium or may be input as values represented on coordinate axes by one of other designation means.

While it is possible that a scanning distance of the primary coating scanning of the on-demand coating head 6 is made to coincide with a coating area and the on-demand coating head 6 is operated in a continuous ON state, it is more advantageous since the apparatus is easily constructed and more uniform coating can be available that the on-demand coating head 6 is scanned beyond the coating area in forward and backward travels and coating is effected in the coating area only.

In consideration of this point, the coating apparatus which has been described in reference to FIG. 1 comprises a the coating control circuit 16 with which the coating head 6 is in a reciprocating manner moved to and from positions beyond edge portion signal addressing positions and liquid droplets are jet inside the edge portion signal addressing positions and the jet of the liquid droplets is stopped outside the edge portion signal addressing positions.

In FIGS. 3A, 3B, 3C a timing chart shows states of control by the coating control circuit 16 and description on the chart will be given. FIG. 3A shows ON/OFF control of the edge sensor, FIG. 3B shows control of a reciprocating movement and stoppage and FIG. 3C shows ON/OFF control of the coating head.

The coating control circuit 16 starts primary scanning by moving the movable table 12 from a home position which is located outside of and to the left hand of the printed medium P. At a timing T1 when the edge sensor 10 on the movable table 12 reaches an edge portion of the printed medium P, an sensor output assumes an ON state.

At a timing T2 when a time t is further elapsed and the coating head 6 reaches on the inside of the edge E1 of the printed medium P, the coating head 6 is made to assume an ON state. At a timing T3, when it is near the terminal point of the scanning, the edge sensor 10 detects the edge E2 and based on the signal, the on-demand coating head 6 is made to assume an OFF state before it goes beyond the edge. Thereafter, at a timing T4 when the on-demand coating head 6 reaches a position spaced apart from the edge E2 outward by a predetermined distance, a forward movement is stopped and at a timing immediately after the stoppage T5, the on-demand coating head 6 is activated in a direction opposed to the above mentioned direction.

The edge sensor 10 detects the edge E2 at a timing T6, but since at this timing the on-demand coating head 6 is inside the edge E2, the on-demand coating head 6 is immediately made to assume an ON state and the ON state is kept in the same distance as in the forward movement and at a timing T7, the ON state is switched to an OFF state. The sensor 10 detects the edge E1 and after a predetermined time is elapsed, scanning is stopped and then scanning in a forward movement is again activated. The coating control circuit 16 determines a traveling distance after the coating head 6 passes over the edges E1,E2 based on whether a time required till the overrunning is naturally stopped or a rise time in which a scanning speed reaches a predetermined value after the scanning is activated in the opposed direction, whichever is longer.

While in the above example of control, the example in which one edge sensor 10 is used has been described, control can be performed with more freedom if two sensors are used as described above and a similar control can be achieved by other means, for example designation of a set of coordinates indicating a coating area or by another by which a scanning position of the coating head 6 can be discerned.

As seen from the above description, if primary coating scanning is performed up to the outside of edges of the printed medium P or a desired coating area, a scanning speed of primary coating scanning can be constant in a stable manner in a coating area and thereby uneven coating can be avoided. In the coating apparatus, coating with a broad area is achieved in such a manner that there is effected, in either of a forward coating scanning and a backward coating scanning, scanning whose elongated band-like coating with a width S extended in a feed direction Y of the printed medium P, said feed direction being a scanning direction Y of secondary scanning, and such scanning in the direction Y is repeated to cover a larger area.

In FIG. 4, the on-demand coating head 6, jet sections 7 mounted on the head and coating states are shown and description on them will be described.

In FIG. 4A, the on-demand head 6 comprises plural jet sections 7 and a coating width in the secondary coating scanning direction is indicated by S.

In b-1 of FIG. 4B, a coated area by a single primary scanning operation is shown by plural circle marks with a oblique line, inclining downwardly to the right hand. A scanning feed of a secondary scanning operation corresponding to a single primary scanning operation is indicted by s. In the case of b-2, a result when a second primary coating operation is conducted in a condition S=s is shown and the second primary coating scanning operation is shown by plural differently decorated circles with an oblique line, upwardly to the right hand for clarity. Coating areas in scanning operations only abut on one another with an interposing line and thereby a poor coating area arises at boundaries between scanning operations if there are fluctuations in secondary coating scanning feed or uneven jet streams at an end portion of the coating head 6. Therefore, in this embodiment, in order to perform coating control in which such a disturbance is prevented from occurrence, when a secondary coating scanning feed corresponding to a single primary coating scanning cycle is indicated by s and a coating width of the coating head in a scanning direction of secondary coating is indicated by S, a condition is set that s<S and thus the embodiment has such a constitution as boundary regions between coating scanning operations are double-coated in a superposed manner.

In FIG. 4C, an example in which a secondary coating feed s is set so as to be S>s is shown. In a definite manner, s=⅚ S. A first scanning is indicated by c-1 and a second scanning is indicated by c-2. In boundaries between scanning operations, circles each with an oblique line upwardly to the right hand or with an oblique line downwardly to the left hand are superposed with one another and it is shown that superposed coating operations have been conducted. In accordance with setting of coating conditions and control based thereon, even if there are fluctuations in the secondary coating feed and uneven jet streams at an edge portion of the coating head and the like, poor coating is prevented from occurrence.

Multiple coating is preferably conducted all over a working area in order to perform uniform and stable coating. Therefore, in this embodiment, the coating head width and the secondary coating feed are set so as to be 2 s≦S.

In FIG. 4D, a situation in which 2 s=S is set is shown. In FIG. 4D, d-1, d-2, d-3 respectively indicates situations after primary coating scanning operations in a first time, a second time and a third time and last parts of the respective coating operations are perfectly superimposed with one another by duplicated coating jets. According to such set coating conditions and control based thereon, even if there are some fluctuations in primary and secondary coating scanning feeds, occurrence of uneven coating can effectively prevented.

An example 1-1 of improvement of the first embodiment will be described.

Generally, there are various reasons for requirements of coating on the surface of a printing medium P already printed and thereby different coating liquids are in need.

For example, in the case of an ink jet printing sheet using a water based ink, water-proof coating is required for improvement of water resistance. It has been an established understanding that almost output images from various printers using dyes, pigment ink or toners are short of UV light resistance and therefore UV cut coating is required. Besides, there has been a need for giving glossiness on a printed image and while the need is satisfied in printing methods of some type, there is still a problem in those methods that highly expensive printing media are required, a long time is necessary for a printing operation and furthermore additional devices or apparatuses are to be provided therein, so that the need for glossiness on the printed media has not still been met and a new coating method for giving glossiness on printed media is on demand. A printed image using a wax based ink is subject to scratches and the like and coating to increase a surface strength is desired. A printed image using a pigment ink prepared by an ink jet printer is sometimes short of a fixing property and therefore coating to improve the fixing property is demanded. There is a case where coating of an auxiliary agent is necessary in order to develop or stabilize a coloring material after the coloring material in an intermediate form is used in a textile printer. Uniform special coating for indication of reproduction inhibition or document secrecy is sometimes required on a printed surface of a secret document.

The first embodiment is to enable coating on the surface of a printed medium with ease in an automatic manner, but in the case where different requirements as mentioned above are demanded in coating, there is a need for cleaning a coating head for each of the different requirements, which is very burdensome and takes a long time in switching between different kinds of coating. Therefore, in the example 1-1 of improvement of the first embodiment, a structure in which plural coating heads applicable to different coating liquids is provided.

Figure 5:
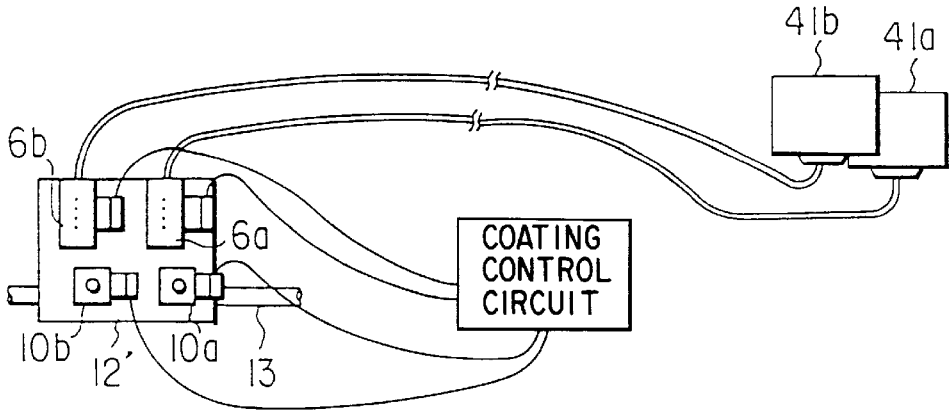
FIG. 5 is a representation showing a structure of an example 1-1 of improvement of the first embodiment.

FIG. 5 is a representation showing the structure of an example 1-1 of improvement of the first embodiment. A movable table 12' in FIG. 5 comprises: a first on-demand coating head 6*a*, a first edge sensor 10*a*, a first coating liquid vessel 41*a* (these are hereinafter referred to as a first system.), a second on-demand coating head 6*b*, a second edge sensor 10*b*, a second coating liquid vessel 41*b* (these are hereinafter referred to as a second system.). The movable table is further provided with a coating control circuit 42 which controls the various parts. The respective parts mentioned above are constituted so as operate in such a manner as described in FIGS. 1 to 4, but this coating control circuit 42 controls operations of the first system or the second system, or both system at the same time.

For example, the case where a UV proof liquid is employed in the first system and a brightener coating liquid is employed in the second system will be considered. It is assumed that in the case where only increase in UV resistance is an object, there is no need for a thick coating film and in the case of glossy coating, a component for UV cut is not included in the liquid. In the case where only UV proof is required, one system, for example the first system is activated. In the case where only glossy coating is required, the other system, that is the second system is only activated. In the case where UV proof and glossy coating are both required, the first and second systems are activated at the same time.

In such a manner, according to the example 1-1 of improvement, a multifunction coating apparatus responding to various requirements in a selective or parallel manner can be realized. The coating liquid vessels may fixedly be mounted on the body of the apparatus.

A second example of improvement 1-2 of improvement of the first embodiment will be described.

In general, in the case where different coating liquids are not simultaneously used, plural coating heads are not necessarily used and such a structure may be adopted which comprises: a coating head accepting one kind of coating liquid; plural coating liquid vessels respectively containing different coating liquids; tubes connecting the plural vessels and the coating head; and means for switching flow paths provided in a tube route.

The second example 1-2 of improvement of the first embodiment is conducted focusing attention on this point.

Figure 6:
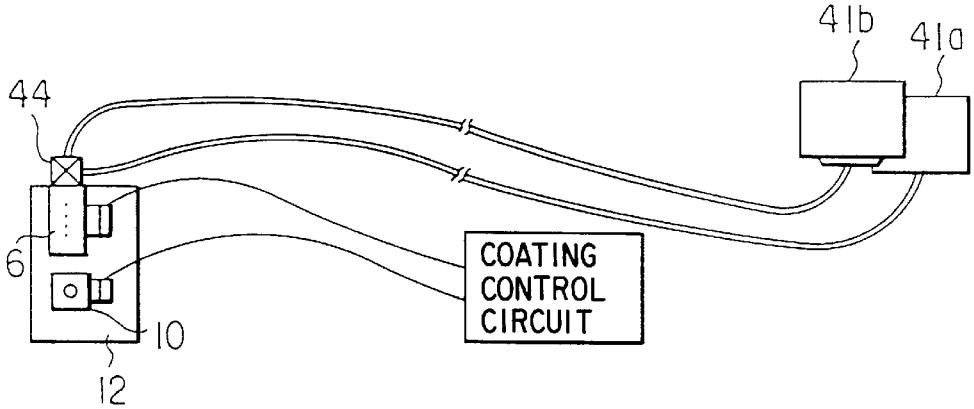
FIG. 6 is a representation showing a structure of a second example 1-2 of improvement of the first embodiment.

FIG. 6 is a representation showing a structure of the second example 1-2 of improvement of the first embodiment. In FIG. 6, a movable table 12, an on-demand coating head 6, an edge sensor 10 are the same as those in FIG. 1. A flow path switching valve 44 is provided in the vicinity of a coating liquid supply port of the coating head 6 and the switching valve 44 is communicated with a first liquid vessel 41*a* and a second coating liquid vessel 41*b*. A mark 43 indicates a coating control circuit. Switching of the coating liquid is performed by use of the switching valve 44 and the valve 44 may be operable by hand or electrical drive.

In the case where changes in drive conditions of the on-demand coating head and coating scanning conditions are required in accordance to kinds of the coating liquids, different mode settings are exerted in the coating control circuit 43 for response. Switching of the coating liquids is performed in such a manner that after the valve 44 is switched, a residual portion of a previously used coating liquid is jet out in a unnecessary portion such as a margin of a printing medium P, a leaders portion or the like.

In such a structure and operations, switching of coating liquids can be achieved with ease, though it is not performed instantly, and a coating apparatus which can cope with plural kinds of coating liquid without any further complexity added can be realized. The coating control circuit 43 is provide with a coating control mode required for switching of coating liquids.

A third example 1-3 of improvement of the first embodiment will be described.

In the third example 1-3 of improvement, in order to facilitate substitution with a new coating liquid without jetting out a previous coating liquid to a margin or a leaders portion of a printed medium, there are provided a waste liquid receiver disposed at a position opposed to the on-demand coating head on the printed sheet side and control means for continuously jetting a coating liquid at a position of the head opposed to the waste liquid receiver.

Figure 7:
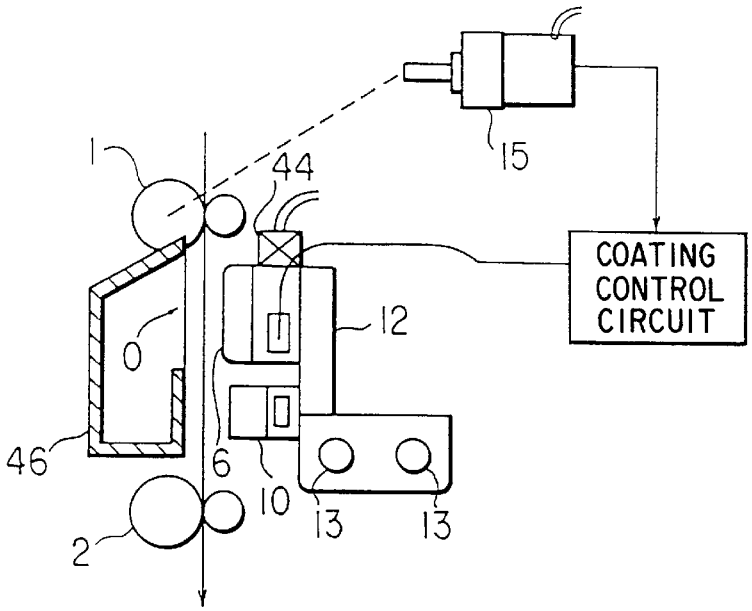
FIG. 7 is a representation showing a structure of a third example 1-3 of improvement of the first embodiment.

FIG. 7 is the representation showing a structure of the third example 1-3 of improvement of the first embodiment. As shown in FIG. 7, the coating liquid receiver 46 is disposed at a position opposed to the on-demand coating head 6 on the printed sheet side, in a detailed manner, at a position corresponding to a home position of the movable table or the like. An opening O is provided to the waste coating liquid receiver 46 and the waste coating liquid from the coating head 6 is guided to the waste liquid receiver 46 without any scattering the waste coating liquid outside the system. A vessel used for receiving a waste liquid is discarded without recycling.

The coating control circuit 45 activates the on-demand coating head 6 for continuous jetting at a home position when switching is performed and replacement is conducted by jetting a previously used liquid into the waste liquid vessel. Since such a structure and operations are adopted, even in the case where a printed medium which does not have a margin or a leaders portion is used, switching of coating liquids can be conducted with no trouble.

A coating apparatus for a printed sheet according to a second embodiment of the present invention will be described. While the first embodiment can be applied to a printed medium which has been discharged from a printing apparatus, it is more preferable if coating is conducted following the last stage of an printing operation when a printed sheet is discharged.

The second embodiment which is described below is a coating apparatus, incorporated in a printer, for applying a coating liquid on the surface of a printing sheet already printed, discharged from a printing section, which comprises: an on-demand coating head, which has plural jet sections arranged in a direction parallel to a discharging direction of the printed sheet, which jets only liquid particles limiting a direction from the respective jet sections by vibration of a high frequency vibrator element, and which produces a coating area having a width extended in the direction parallel the edges; primary coating scanning means reciprocating the on-demand head while traversing the printed medium along a direction crossing the edges; signal producing means for producing an edge position signal indicating at least one or both of a effective image edge position and a printed medium edge position in the primary coating scanning direction on the printed medium; and control means for controlling at least one of liquid droplet jet from the on-demand coating head and a reciprocating movement of the on-demand coating head based on the edge position signal or signals.

Figure 8:
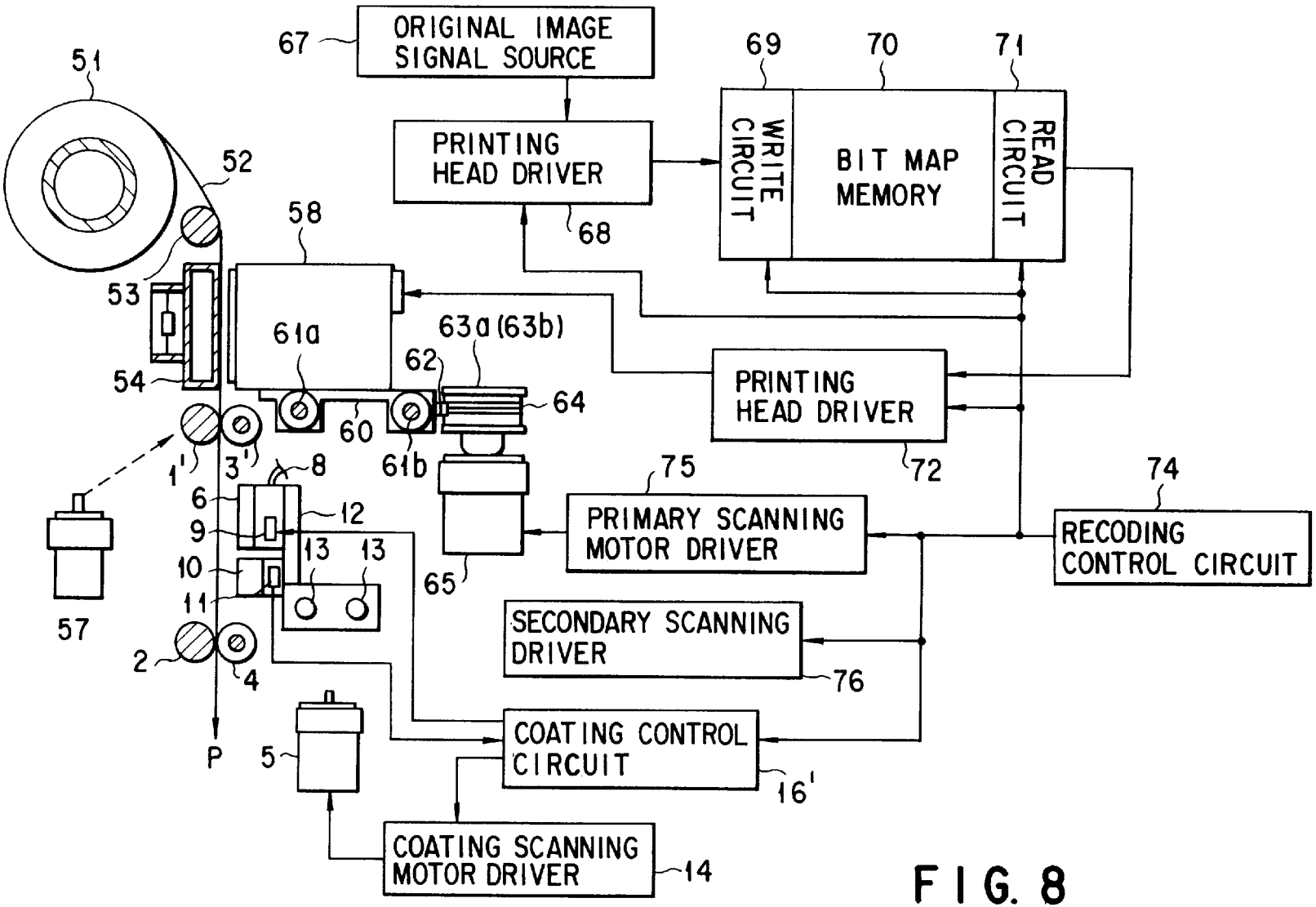
FIG. 8 is a view showing a structure of a coating apparatus according to a second embodiment.

FIG. 8 is a view showing a structure of a coating apparatus according to a second embodiment. In FIG. 8, an ink jet printer is used as a printer. The ink jet printer comprises: a printing medium 52 wound in a recording medium roll 51; a guide roller 53 for feeding a recording paper sheet 52; a nip section between a feed roller 1' and a pinch roller 3'; an ink jet printing head 58 (hereinafter referred to as a printing head); a platen 54 comprising a negative pressure suction box sucking the printing medium 52 when the printing medium 52 passes through a scanning region of the printing head 58; a movable table 60, loaded with the printing head 58, capable of moving along a primary scanning direction and supported by guide rails 61*a*, 61*b* provided along a direction perpendicular to a transportation direction (a secondary scanning direction) of the printing medium 52; a pair of pulleys 63*a*, 63*b* and a hook 62 fixed on the movable table 60 wherein a wire 64 is extended over the pair of pulleys 63*a*, 63*b* and the hook 62; a secondary scanning motor 57 feeding stepwise the printing medium 52 along the secondary scanning direction perpendicular to the primary scanning direction in synchronization with scanning of the recording head 58 while rotating intermittently; a primary scanning motor 65 capable of rotating in a positive or negative direction in a direct connection with the pulley 63*a*; a bit map memory 70 for temporarily storing a raster image signal by way of a printing image signal circuit 68 from a printing original image signal source 67; a write circuit 69 for directing a write operation to the bit map memory 70; a read circuit 71 for directing a read operation; and a printing head driver 72 for driving the printing head 58 based on an image signal read out.

In the second embodiment, the printing head 58 comprises plural ink jet sections (ink jet nozzles), ink jet positions are determined by arrangement of the ink jet nozzles and a multi-element ink jet printing head, which can individually control ink jet streams toward the printing medium from the respective ink jet nozzles, is applied. As a printing head of a dot on-demand type which comprises a partitioned room and nozzle openings, there have practically been used a bubble jet or a thermal jet using thermal energy for jetting, a piezo jet using a strain arising by a voltage application on a piezoelectric element or the like and those are preferably used for this embodiment.

The ink jet printer is integrally built with a coating apparatus and such an apparatus comprises: an on-demand coating head 6; a tube 8 supplying a coating liquid to the coating head; a sensor unit held on a movable table 12, said sensor unit being integrally constructed of a coating head unit which is integrally constructed including a power supply connector 9, an edge sensor 10 and a connector 11. The movable table 12 reciprocally moves on guide rails 13 by way of transmission means by means of a driving force of a coating scanning motor 5. Other parts will further be described. A mark 2 indicates a feed roller, a mark 4 indicates a opposed roller and the opposed roller 4 is preferably a roller which has a small contact area on the surface of a printed medium, for example a star wheel, and thereby it is preferred that a coating liquid on the printing medium which does not perfectly dried is not displaced.

Operations of the apparatus according to the second embodiment will be described.

The printing medium 52 wound off from the printing medium roll 51 is fed to the guide roller 53 and to the nip section between the feed roller 1' and the pinch roller 3' in a continuous manner. At this point, the platen 54 vacuum sucks so that the printing medium 52 does not float up when the medium 52 passes through a scanning region of the recording head 58.

The primary scanning motor 65 repeats positive and negative rotations in direct connection with the pulley 63*a* and activates a reciprocating movement along the primary scanning direction of the recording head 58. The secondary scanning motor 57 rotates intermittently and sends stepwise the printing medium 52 along the secondary scanning direction perpendicular to the primary scanning direction in synchronization with scanning of the recording head 58.

A raster image signal from the print original image signal source 67 passes through the print image signal circuit 68, temporarily written in the bit map memory 70 by a direction of the write circuit 69, read out by a direction from the read circuit 71, wherein the read operation is conducted in the following order of a nozzle arrangement of the printing head 58, a primary scanning movement, as timing suitable for a designated printing mode and an address. The read out printing image signal is transmitted to the printing head driver 72 and the printing head driver 72 drives the printing head 58. Matching of the printing image signal with rotations of the primary scanning motor 65 and the secondary scanning motor 57 and the like are performed by sending directions from the recording control circuit 74 working as a center of the recording control section to the write circuit 69 and the read circuit 71 in the memory, the primary scanning motor driver 75 and the secondary scanning motor driver 76.

The printing medium which is finished with printing is fed stepwise by way of the feed roller 1' and the pressure roller 3' and passes through a position opposed to the on-demand coating head 6 and a position opposed to the edge sensor 10.

The coating scanning motor driver 14 is activated by a direction of the coating control circuit 16' based on information from the recording control circuit 74 at a timing when a sheet portion of the printed medium reaches the coating apparatus portion and the coating scanning motor 5 is thereby further activated. The coating control circuit 16' first obtains a signal of the edge sensor 10 and then controls an operation of the coating head 6 based on the signal.

Preferred examples of an on-demand coating head which can be applied to the apparatus constructed in such a manner are as described in FIGS. 1, 2.

With a structure that a coating apparatus is integrally incorporated in the printer having such a structure as mentioned above, coating can be performed at the same time when a printed medium is discharged. Therefore, this is by far speedier and simpler, compared with a conventional method such that coating or lamination is conducted separately from printing after the whole process of printing is over. Besides, one transportation mechanism is commonly used for transportation of a printed medium for coating and for discharge of a printing medium already printed from a printer and support for the coating apparatus is constructed smaller by commonly using structural members of the printer, whereby a small scale coating apparatus with a low cost can be realized.

It is preferred to control an operation of the coating apparatus which is incorporated integrally with the printer, as mentioned above in FIG. 3. That is, in the coating apparatus which is incorporated integrally with the printer, the coating head is in a reciprocating manner moved till a position beyond an edge portion signal address position and liquid droplets are jet inside the edge portion signal address position, while jetting of liquid droplets is stopped outside the address position. The operations of such a constitution are as described in a timing chart of FIG. 3 and therefore detailed description is herein omitted.

According to the above mentioned constitution, since coating can be started in a stabilized condition in which a moving speed of the coating head is steady at an edge of the printed medium, coating can be conducted in such a manner that no uneven thickness arises in the edge portion of the printed medium.

A example 2-1 of improvement of the second embodiment will be described below.

In a coating apparatus which is integrally incorporated in a printer, coating has to be performed at a speed corresponding to a printing speed of the printer. A coating apparatus is desired in which there is available such a degree of margin as poor coating does not happens even against fluctuations in the printing speed of the printer.

Therefore, in a coating apparatus for a printed sheet according to the example 2-1 of improvement of the second embodiment, a coating apparatus according to claim 2 which is integrally incorporated in a printer is constituted so that when a feed of a printed medium corresponding to one primary coating scanning cycle is indicated by s and a coating width of the coating head is indicated by S, there is provided control means with which the coating width of the coating head and the feed of the printed medium is set in a relation of s<S and at least boundary portions of coating scanning are double coated.

The operations having the above mentioned constitution are illustrated in FIGS. 4C, 4D and the like and since boundary portions between coating operations are double coated, non-coated portions arise even if fluctuations happen in feed of a printed medium or the like. Setting of the s and S will be described. When the maximum feed of a printed medium in a printer is indicated by sMAX, if a coating head is set so as to be a coating width S<sMAX, coating can be performed for all the modes available for the printer. However, in the case where only a coating head which can be set so as to be sMAX>S can be mounted, a restriction condition is given in mode setting of the recording control circuit 74 so that a printing mode in which a small feed rate for the printer is set in order to achieve a relation S>s in use of the coating apparatus.

For example, in an ink jet printer, a draft mode and a high speed printing mode are prohibited and restrictions which accepts an interlace printing mode and the like are given.

As described in FIG. 4D, uniformity can be improved by giving multiple coating all over the surface. Therefore, the coating apparatus has a constitution that comprises control means for setting a relation between a coating width of a coating head and a feed of a printed medium as 2s≦S.

In the above mentioned constitution, in the case where the coating width S of a coating head can be set at a sufficiently larger value, there is no need for giving a restriction on operational conditions of the printer, but in the case where a relation of 2s≦S at the maximum printing speed is not satisfied, a restriction is given in setting of the recording control circuit 74 so that a relation of 2s≦S is realized by giving a restriction on an operational mode of the printer.

A example 2-2 of improvement of the second embodiment will be described below.

There are a printer which has a constitution that a printing speed is largely changed, as a typical example an ink jet printer.

In the case where a constitution that a printing head is reciprocally moved and a printed medium is moved by a secondary scanning operation, for example in the case of the constitution as illustrated in FIG. 8, while a printing area in the shape of a band is formed along each primary scanning direction and the bands are connected along a secondary scanning direction in order to extend a printing area, there has widely used in practical aspects a printing mode called interlace printing mode in which printing of a given band is conducted in the number of n of scanning operations wherein a scanning position is displaced between a subband and the next subband by 1/n along the secondary scanning direction in order that fluctuations in density at boundaries or within a band may be inconspicuous and a value of n can be selected according to a required quality of an image.

In this case, a discharge speed of a printed medium is largely changed in a reverse proportion to a value of n. Therefore, proper coating cannot be achieved if operational conditions of the coating apparatus are constant.

Therefore, in a example 2-2 of improvement, the coating apparatus comprises: means for sending out a signal indicating a discharge rate of a printed medium; and the coating control means for controlling a reciprocating movement of the coating head and/or ON/OFF of liquid droplet jet and/or a jet rate of the liquid droplets, whereby the above mentioned problem is solved.

That is, in FIG. 8, a printing mode of a printer is set in a recording control circuit 74 and information pieces of a discharge speed of the printed medium, a width of a step feed corresponding to one primary scanning operation of the printed medium are transferred to the coating control circuit 14. The coating control circuit 14 changes an operational mode in order to control a coating quantity according to the information pieces.

A change in coating quantity can be achieved by means as below described.

A first method is to change of a cycle in primary coating scanning. That is, a cycle of the primary coating scanning is slowed as a feed rate of the printed medium is reduced to adjust a coating thickness. In this case, adjustment of a cycle is conducted by adjusting a waiting time at the turning point of coating scanning.

A second method is to change a jet rate of a coating liquid by a change in driving conditions so as to have the jet rate of the coating head changed. The driving conditions can be selected to be a driving voltage of the coating head and/or driving frequency. It is needless to say that it is possible to use a combination of the first and second methods in execution.

A example 2-3 of improvement of the second embodiment will be described below.

While the second embodiment is that in which movement mechanisms for scanning of the printing head and primary coating scanning are independently constructed, both scanning mechanisms can be one mechanism commonly used in order to simplify an apparatus.

Therefore, in this example 2-3 of improvement, an apparatus has a constitution that in the above mentioned apparatus, a printer conducts primary scanning by a reciprocating movement of a printing head, and secondary scanning by transporting a printing medium stepwise and the coating head is held on a movable table of the printing head in an integral manner.

Figure 9:
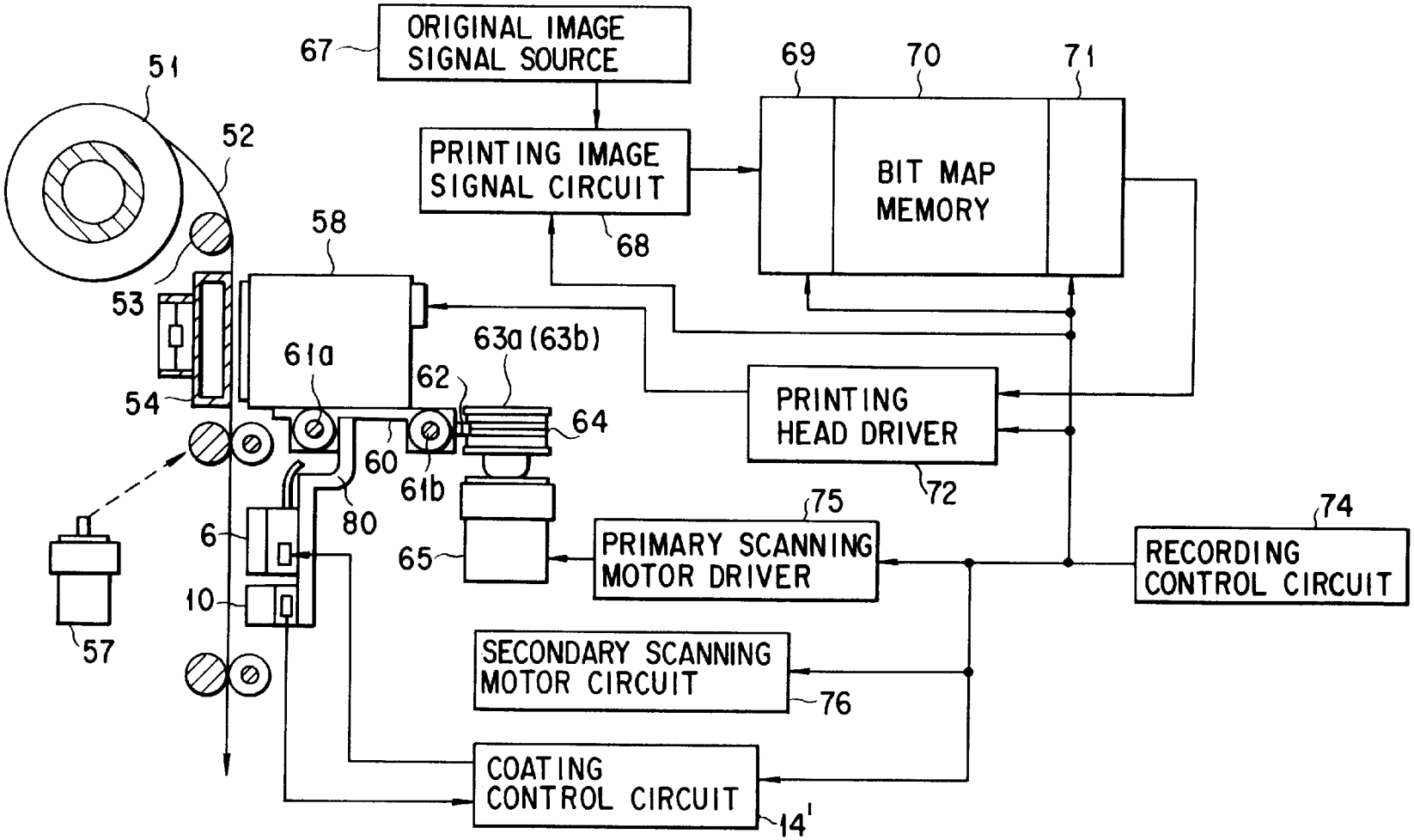
FIG. 9 is a view showing a structure of an example of improvement of the second embodiment.
Figure 10:
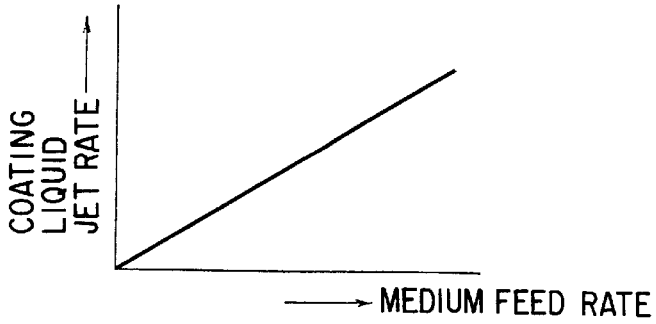
FIG. 10 is a graph showing a relation between the jet rate of a coating liquid and the feed rate of a medium.

FIG. 9 is a view showing a structure of an example 2-3 of improvement of the second embodiment. In FIG. 9, a member indicated by the same mark as a member of FIG. 8 has the same behaviors and actions as those of the member of FIG. 8. In this example, a holder 80 is integrally mounted to a movable table 60 of a printing head 58 and an on-demand coating head 6 and an edge sensor 10 are mounted on the holder 80. A coating control circuit 14' controls a movement of the coating head in the above mentioned constitution. That is, since in the above constitution, the on-demand coating head in a reciprocating manner moves in one body with the printing head 58 which conducts a reciprocating scanning, control of coating can be effected by control of only ON/OFF of coating and/or a jet rate of the coating liquid and cannot be changed by a cycle of a reciprocal movement or stop the movement. In the case where a discharge rate is slowed in a corresponding manner to a change in a discharge rate of a printed medium, control is executed in such a manner that jet of the coating liquid is not conducted in every scanning, the jet of the coating liquid is not conducted in one of n times of scanning or a jet rate from the coating head (see FIG. 10) is reduced to 1/n for control. According to this example 2-3 of improvement, primary scanning feed mechanism of the coating head can be used for a primary scanning feed mechanism of the printing head in a common use.

A printing apparatus for a printed sheet according to a third embodiment of the present invention will be described below. While in the coating apparatus in which coating is performed by in a reciprocating manner moving the on-demand coating head in the above mentioned embodiment, a structure in which a coating liquid can in a reciprocating manner be moved in one body with the coating head, it is reasonable that the coating liquid is fixedly disposed and it is fed through a supply tube.

However, in this case, there is a need for means for guiding the supply tube in matching with a reciprocal movement of a coating head, which makes the apparatus complex.

Therefore, in the third embodiment, which will be described below, the apparatus in which a coating head is held in an integral manner with a movable table of the printing head, which comprises: a printing head as an ink jet printing head; an ink vessel fixedly mounted to the printer body; a flexible tube extending from the ink vessel to the printing head; a cable guide for protecting and guiding interconnects and the tube by moving in a following manner with a reciprocating movement of the printing head, wherein the coating liquid vessel fixedly mounted to the printer body and the flexible tube connecting the vessel and the coating head are accommodated in the cable guide.

Figure 11A:
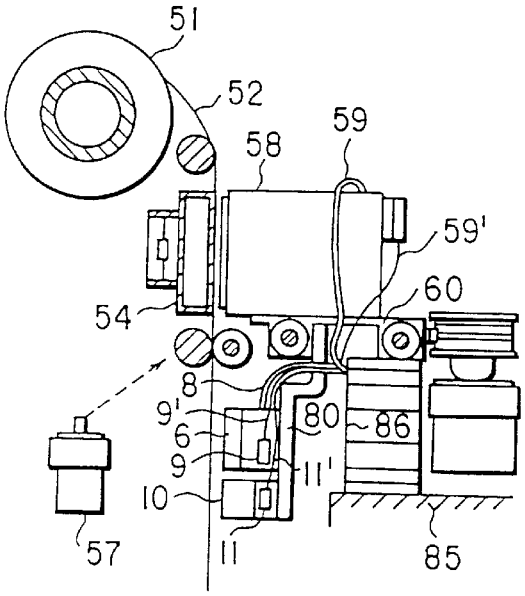
FIG. 11A is view showing the structure of a coating apparatus according to a third embodiment and FIG. 11B is a view showing in detail the parts near the cable guides of the coating apparatus according to the third embodiment.
Figure 11B:
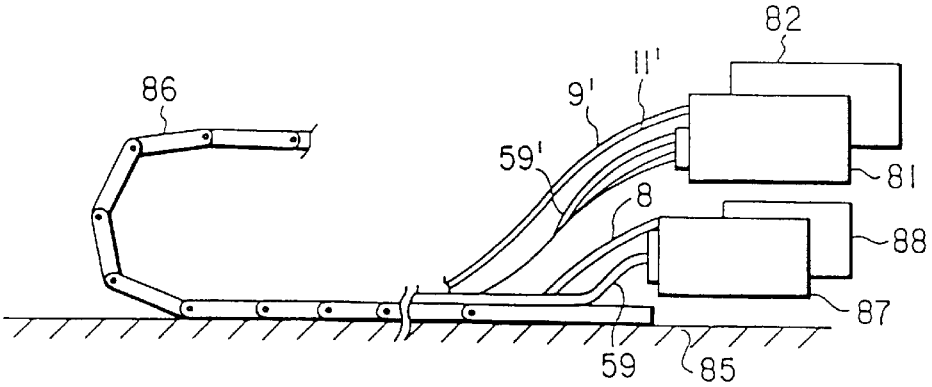

FIG. 11A and 11B are a view showing a structure of a coating apparatus according to the third embodiment. In FIG. 11A and 11B, a base table 85 is provided for a printer and a cable guide 86 is disposed on the base table 85. In the cable guide 86: there are included a flexible tube 59 which is used for supply of an ink from an ink bottle 87 to an ink jet printing head 58; and a wire 59' from a board 81 to supply a signal to the ink jet printing head 58; in addition a flexible tube 8 connecting the coating head 6 and a coating liquid vessel 88; a connector 9 of the coating head; and interconnects 9', 11' connecting a connector 11 of an edge sensor 10 to a coating control circuit board 82.

An end of the cable guide 86 is fixed to the base table 85 with an articulated body having a caterpillar like structure and the other end is fixed to a movable table 60. The flexible tube 8 and the wire are guided in a protecting manner in the cable guide 86 and can migrate without any damage.

Various improvements can be achieved in the embodiment in which a coating head is held in body with a movable table of the printing head.

The example 3-1 of improvement has a structure in which plural coating heads used for different coating liquids are provided on a support table, which supports the coating head, moving along a primary coating scanning direction. This example of improvement is a structure which is constructed by applying a structure shown in FIG. 5 to FIGS. 8, 9 and since an action and effect when adopting such a structure are same as those in described in FIG. 5, description on this is omitted herein.

The example 3-2 of improvement comprises: a coating head accepting plural kinds of coating liquid; scanning means; plural coating liquid vessels held by the printer body, which contains different coating liquids; a tube connecting between the vessels and the coating head; and a flow path switching means provided in a tube route. This example of improvement is constructed by applying a structure shown in FIG. 6 to FIGS. 8, 9 and an action and effect of this constitution are same as those in described in FIG. 6.

An example 3-3 of improvement has a structure which in addition to the above mentioned example of the second embodiment, comprises: a waste liquid receiver disposed at a position opposed to a home position of the coating head on the printed sheet side; and control means for continuous jetting of the coating liquid at a position of the coating head opposed to the waste liquid receiver. This structure is constructed by applying the embodiment of FIG. 7 to the embodiments of FIGS. 8, 9 and since an action and effect thereof are same as those of FIG. 7.

A coating apparatus for a printed sheet according to a fourth embodiment of the present invention will be described below. While the constitutions shown in the embodiments show constitutions in which coating is applied by a reciprocating movement of a coating head, the fourth embodiment is not limited to those constitutions, constructed as a printed sheet coating apparatus of a stationary coating head, in which a coating head with a broad width is employed.

That is, the embodiment is an apparatus to apply a coating material in a liquid state on the surface of a printed medium which comprises: a page-wide coating head unit mounted so as to correspond to the maximum width of the printed medium along a direction perpendicular to a feed direction of the printed material; a coating head unit, in which an on-demand coating head is disposed so as to traverse the printed medium in a width direction in such a manner that the printed medium is divided in plural sections, wherein there is provided a structure in which control can be made with a section as a unit, said on-demand coating head having plural jet sections, jetting only liquid droplets limiting a direction from the respective jet sections by vibration of a high frequency vibrator element, and producing a coating area in the shape of a band extended in a direction perpendicular to the feed direction of the medium; a signal producing means for producing an edge position signal indicating an edge position in each section of the printed medium along a arrangement direction of the sections; and control means for controlling the coating head with a section as a unit based on the edge position signal and a signal indicating feed of the printed medium.

Figure 12A:
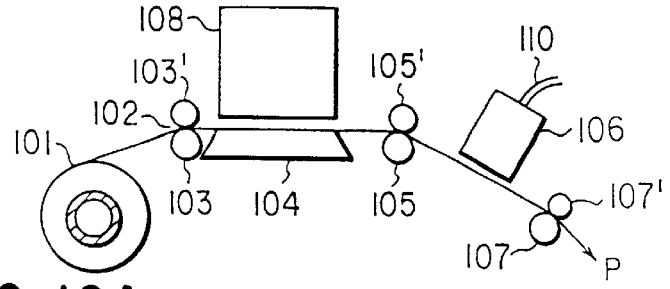
FIG. 12A is a view of a supply/feed system in the periphery of a printing head of a coating apparatus according to a fourth embodiment and FIG. 12B is a view of a control system in the periphery of the printing head of the coating apparatus according a fourth embodiment.
Figure 12B:
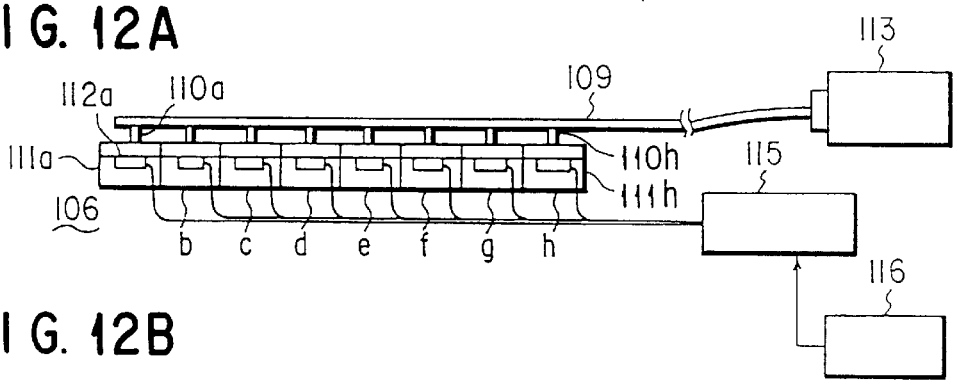

FIGS. 12A, 12B are a structure of a coating apparatus for a printed sheet according fourth embodiment. In FIG. 12A, 101 indicates a printing medium feed roll and a taken-out printing medium 102 passes through a guide roller 103 and a feed roller 105 disposed before and after a platen 104 and further is brought to a discharge roller 107. A printing head 108 is disposed at an opposed position to the platen 104 and a coating head 110 is disposed between the feed roller 105 and the discharge roller 107 at a opposed position to the printed surface of the printing medium. Pressure rollers 103', 105', 107' are disposed at respective positions opposed to the guide roller, the feed roller and the discharge roller.

While the apparatus shows a coating apparatus which is constructed in one body with a printer in an incorporated manner, a printed medium already printed can be subjected to coating in a separate coating apparatus. As the printing head 108, various types such as a printer of a thermal type, a printer of an ink jet type or the like can be applied and the head may be a type having a page wide printing head and a constitution of a serial printer in which a head is scanned.

The coating head 110 comprises plural jet sections and only liquid droplets are jet as a high speed stream by vibration of a high frequency vibrator element and what is described in FIGS. 1, 2 is applied. The embodiment has a feature that the on-demand coating head has a width of the printed medium, that is a broad width having a jet area which covers a dimension of the printed medium in a direction perpendicular to a feed direction of a printed medium and the head is employed in a fixed manner and the jet area has a divided structure that is divided into plural sections and jetting control can be performed with a section as a unit. That is, the on-demand coating head 111 is divided into segments 111*a*, 111*b*, . . . , 111*h*, connectors a, b, . . . , h are provided to the respective segments and they are connected to the coating control circuit 115, whereby control for each segment can be performed.

Marks 111*a* to 111*h* indicate tubes to respective coating heads and respective tubes are connected to a coating liquid vessel 113 through a common supply tube 109. A mark 116 indicates means for producing an edge position signal of the printed medium and the signal may be produced by using input means such as a key board for each printed medium or the signal can be produced by detecting an edge position of the printed medium using a sensor not shown. The coating head divided into segments corresponds to the width of a printed medium and segments which are at positions not corresponding to the printed medium are made to be out of operation by directions of the control circuit 115.

According to the fourth embodiment, coating can be performed without a mechanical scanning mechanism for coating by selectively activating the coating head 111*a* to 111*h* in correspondence to transportation of a printed medium and not only can a high speed coating be also realized, but there can also be achieved a coating apparatus, which does not contaminate the apparatus body and the surroundings, and which does not consume any unnecessary coating liquid as shown in FIG. 1,2.

An example 4-1 of improvement of the fourth embodiment will be described below.

In the case where the coating head is constructed of segments, there is a fear that gaps arise between boundaries of the segments depending of a way of assemblage thereof. Therefore, in the example 4-1 of improvement described below, in order to prevent such a defect, the segmented coating head unite is constructed so that the segments are overlapped between adjacent segments at boundaries.

Figure 13A:
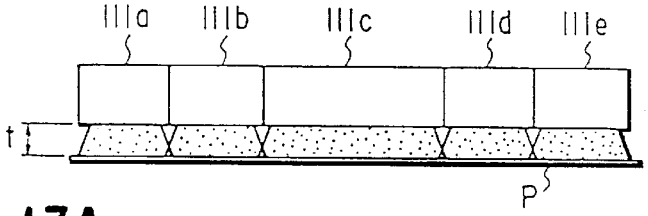
FIG. 13A is a view showing a state in which segmented on-demanded coating heads 111*a* to 111*e* in a structure of a coating apparatus according to an example 4-1 of improvement of the fourth embodiment are arranged in a line.
Figure 13B:
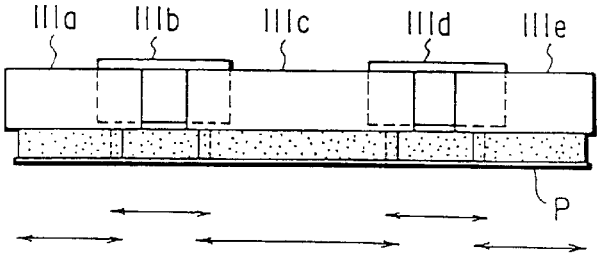
FIG. 13B is a view showing a structure in which the coating heads are arranged in two rows, spaced apart in front and in rear, extending along a moving direction of a printed medium with the respective heads alternately taking positions in front and in rear rows in the moving direction in a structure of a coating apparatus according to the example 4-1 of improvement of the fourth embodiment.

FIGS. 13A, 13B are views showing examples 4-1 of improvement.

In FIG. 13A, the on-demand coating head 111*a* to 111*e* are disposed in a line. The coating head is formed so that a jetting direction expands in the shape of a circular cone with a vertex at a nozzle as a jet stream flies away and a coating area on the surface of a printed medium is adjusted so as to be overlapped at the boundaries of segments by properly setting a distance between the coating head and the printed medium.

FIG. 13B has a structure in which the coating heads are arranged in two rows, spaced apart in front and in rear, extending along a moving direction of a printed medium with the respective heads alternately taking positions in front and in rear rows in the moving direction, since the coating liquid jets a direction normal to the front face of the coating head and therefore gaps between segments in a structure in which the segments are simply arranged in a line adversely affect uniformity of coating. 111*a*, 111*c* and 111*e* are aligned in a front row but 111*b* and 111*d* are aligned in a rear row. The segments are disposed so that two adjacent coating areas of corresponding two segments overlap at a boundary therebetween.

In the coating apparatus for a printed sheet which is the fourth embodiment using the on-demand coating head with a broad width, too, a structure similar to those shown in FIGS. 5 to 7 and the like can be assumed in connection with the first embodiment.

An example 4-2 of improvement shows a structure which comprises plural sets of coating head units applied for different coating liquids in a coating apparatus with the above mentioned coating head with a broad width.

Figure 14:
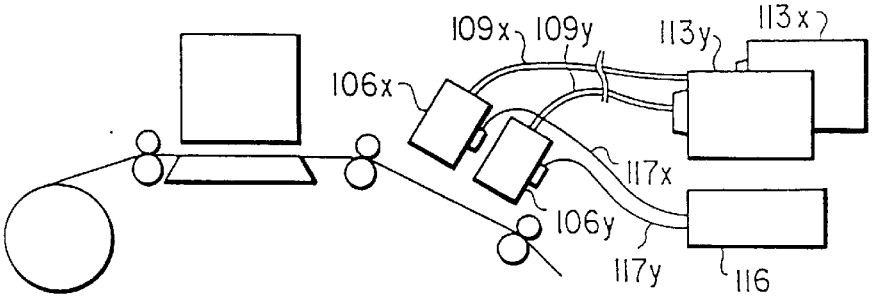
FIG. 14 is a representation showing a structure of a coating apparatus according to a first example 4-2 of improvement of the fourth embodiment.

FIG. 14 is a representation showing a structure of the example 4-2 of improvement.

In FIG. 14, marks 106*x*, 106*y* indicate on-demand coating heads each with a broad width and are respectively applied to different coating liquids. Marks 113*x*, 113*y* indicate coating vessels containing different coating liquids and respectively connected with supply tubes 109*x*, 109*y*. Marks 117*x*, 117*y* indicate interconnect wires which connect with a coating control circuit 116. The coating control circuit 116 not only controls drive of the coating head matching with the width of a printed medium but selects in a controlling manner one of the coating heads 106*x*, 106*y*, whichever is to be activated. Kinds of the coating liquids and selection thereof have in detail been described in FIG. 5, which is applied to this embodiment in a similar manner.

An example 4-3 of improvement is a coating apparatus with a coating head having a broad width which comprises: a pair of coating units; plural coating vessels accommodating different coating liquids; tubes connecting the plural vessels with the pair of coating heads; and flow path switching means disposed in the tube route.

Figure 15:
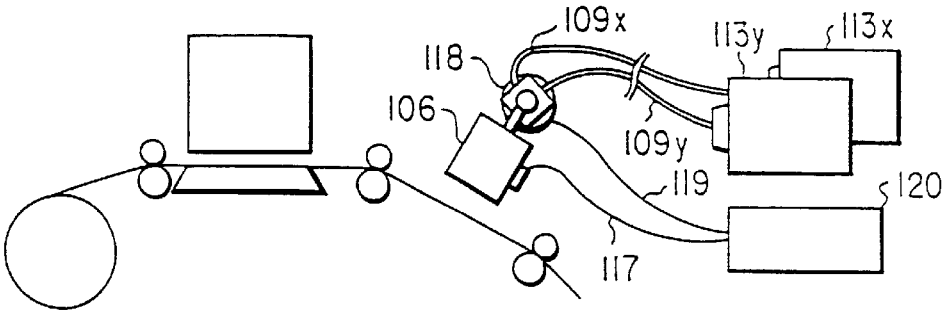
FIG. 15 is a representation showing a structure of a coating apparatus according to a second example 4-3 of improvement of the fourth embodiment.

FIG. 15 is a representation showing a structure of the example 4-3 of improvement.

In FIG. 15, a mark 106 indicates a coating head unit with a broad width. Marks 113*x*, 113*y* indicate coating vessels accommodating different coating liquids and a mark 118 indicates a flow path switching valve and marks 109*x*, 109*y* indicate tubes. The flow path switching valve 118 and the coating head 106 are connected to a coating control circuit 120 by interconnects 119, 117. The coating control circuit 120 controls in a selecting manner segments of the coating head unit, and operates the flow path switching valve 118 to select a coating liquid to be used and thereafter supply the selected liquid to the coating head unit 106. When coating liquids are exchanged, A previous coating liquid in the coating head is jet on a margin of a printed medium until the previous liquid is perfectly substituted with a new coating liquid and thereafter a coating operation is started and this control is performed by the coating control circuit 120 as well.

An example 4-4 of improvement has a structure in which substitution of a coating liquid is conducted without jetting out a previous liquid on a margin of a printed medium.

That is, in a coating apparatus which comprises: a coating head with a broad width; plural coating liquid vessels; and flow path switching means, there are further included a waste liquid receiver disposed at a position opposed the coating head unit on the printed medium side and control means which makes a coating liquid continuously jet from a coating head unit independently of feed of a printed medium.

Figure 16:
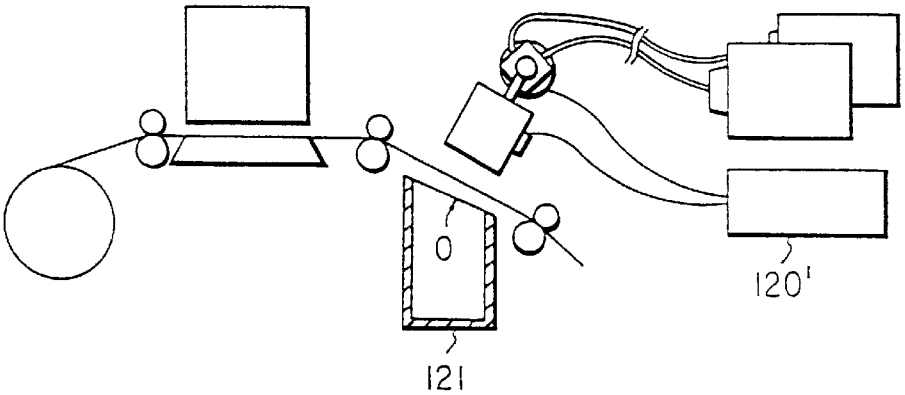
FIG. 16 is a representation showing a structure of a coating apparatus according to a third example 4-4 of improvement of the fourth embodiment.
Figure 17:
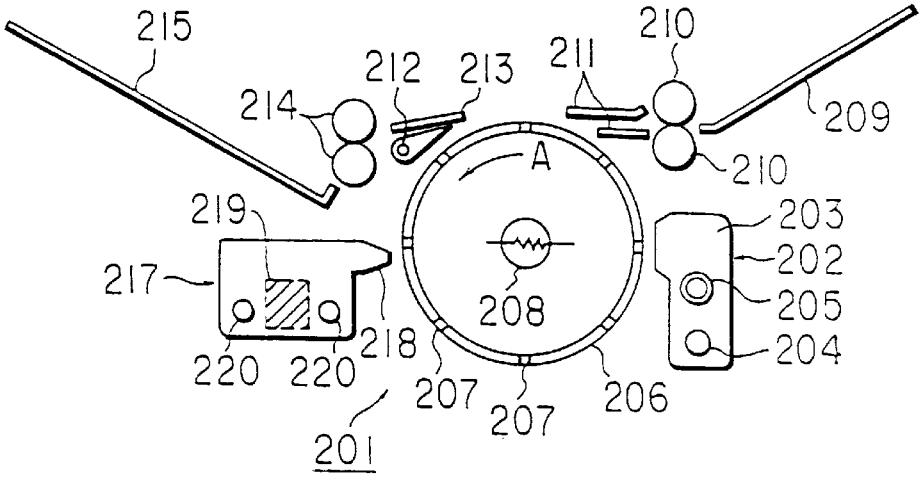
FIG. 17 PRIOR ART
FIG. 17 is a view showing a structure of a printing apparatus incorporating a coating apparatus according to a conventional technique.

FIG. 16 is a representation showing a structure of the example 4-4 of improvement.

In FIG. 16, a mark 121 indicates a waste liquid receiver disposed at a position on the printed medium side opposed to a coating head unit and a sectional view thereof is shown. The waste liquid receiver has an opening O on the side thereof facing the coating head unit and when there is no printed medium, the opening directly faces the coating head unit 106. A coating control circuit 120' controls so that exchange of coating liquids is conducted by continuously jetting a coating liquid in a condition where a printed medium is not present before the coating head unit. The waste liquid receiver preferably is a throw-away one, such as a paper vessel.

As has in a detailed manner been described, according to the embodiments of the present invention, there can be realized a coating apparatus for a printed sheet with which a coating liquid is not scattered outside the surface of a printed sheet and therefore, there is no problems in an operation indoors.

There can be realized a coating apparatus for a printed sheet, which is integrally incorporated in a printer, which is automated, and with which a coating liquid is not scattered outside the surface of a printed sheet.

There can be realized a coating apparatus for a printed sheet, which can secure a predetermined thickness in a following manner with a different feed rate of a printed medium, and therefore which can integrally be incorporated in printer of a variable printing speed type.

There can be realized a coating apparatus for a printed sheet which can adjust a coating area on a printed sheet, whose width is different, or which has a printed area of a different width, automatically and with ease in a freely corresponding manner.

There can be realized a coating apparatus for a printed sheet, which can easily select a coating material with a different action and effect.

There can be realized a coating apparatus for a printed sheet, which consumes an unnecessary consumption of a coating liquid a little.

The above mentioned embodiments comprises the following invention.

(1) A coating apparatus for a printed sheet in which a coating material in a liquid state is applied on a medium already printed, which comprises:

an on-demand coating head, which has plural jet sections arranged in a direction parallel to the left and right side edges of the printed medium, which produces a coating area having a width extended in the direction parallel the edges, and which jets only liquid droplets along a predetermined direction from the respective jet sections by vibration of a high frequency vibrator element;

primary coating scanning means reciprocating the on-demand head on the printing along a direction crossing the edges;

secondary coating scanning means for moving the on-demand coating head and the printed medium along a direction perpendicular to the edge crossing direction in a relative manner;

signal producing means for producing an edge position signal showing at least one of an effective image edge position and a printed medium edge position in the primary coating scanning direction on the printed medium; and coating control means for controlling at least one of liquid droplet jet from the on-demand coating head and a reciprocating movement of the on-demand coating head based on the edge position signals.

(2) A coating apparatus for a printed sheet set forth in (1), wherein the coating control means with which the on-demand coating head is in a reciprocating manner moved to and from positions beyond edge signal addressing positions and liquid droplets are jet inside the edge signal addressing positions and the jet of the liquid droplets is stopped outside the edge signal addressing positions.

(3) A coating apparatus for a printed sheet set forth in (1), wherein when a secondary coating scanning feed corresponding to a single primary coating scanning cycle is indicated by s and a coating width of the coating head in a scanning direction of secondary coating is indicated by S, a condition is set that $s<S$ and boundary regions between coating scanning operations are double-coated in a superposed manner.

(4) A coating apparatus for a printed sheet set forth in (3), wherein the coating width of the on-demand coating head and the secondary coating feed are set so as to be $2s \leqq S$.

(5) A coating apparatus for a printed sheet set forth in (1), wherein the coating apparatus comprises plural on-demand coating heads applicable to different coating liquids are provided.

(6) A coating apparatus for a printed sheet set forth in (1), wherein the coating apparatus comprises: a coating head accepting one kind of coating liquid; plural coating liquid vessels respectively containing different coating liquids; tubes connecting the plural vessels with the coating head; and means for switching flow paths provided in a tube route.

(7) A coating apparatus for a printed sheet set forth in (6), wherein the coating apparatus further comprises: a waste liquid receiver provided at a position opposed to the on-demand coating head on the printed sheet side and the coating control means for continuously jetting a coating liquid at a position of the on-demand coating head opposed to the waste liquid receiver.

(8) A coating apparatus for a printed sheet of an integrated-in printer type in which a coating liquid is applied on the surface of a medium already printed discharged from a printing section, which comprises:

an on-demand coating head, which has plural jet sections arranged in a direction parallel to a discharging direction of the printed sheet, which jets only liquid droplets limiting a direction from the respective jet sections by vibration of a high frequency vibrator element, and which produces a coating area having a width extended in the direction parallel the edges;

primary coating scanning means reciprocating the on-demand coating head while traversing the printed medium along a direction crossing the edges;

signal producing means for producing an edge position signal indicating at least one of an effective image edge position and a printed medium edge position in the primary coating scanning direction on the printed medium; and control means for controlling at least one of liquid droplet jet from the on-demand coating head and a reciprocating movement of the on-demand coating head based on the edge position signal or signals.

(9) A coating apparatus for a printed sheet set forth in (8), wherein the coating control means controls so that the on-demand coating head is in a reciprocating manner moved to and from positions beyond edge signal addressing positions and liquid droplets are jet inside the edge signal addressing positions and the jet of the liquid droplets is stopped outside the edge signal addressing positions.

(10) A coating apparatus for a printed sheet set forth in (9), wherein when a secondary coating scanning feed corresponding to a single primary coating scanning cycle is indicated by s and a coating width of the coating head in a scanning direction of secondary coating is indicated by S, a condition is set that $s<S$ and boundary regions between coating scanning operations are double-coated in a superposed manner.

(11) A coating apparatus for a printed sheet set forth in (10), wherein the coating width of the on-demand coating head and the secondary coating feed are set so as to be $2s \leqq S$.

(12) A coating apparatus for a printed sheet set forth in (8), wherein the coating apparatus further comprises: means for sending out a signal indicating a discharge rate of a printed medium; and the coating control means for controlling a reciprocating movement of the on-demand coating head and/or ON/OFF of liquid droplet jet and/or a jet rate of the liquid droplets.

(13) A coating apparatus for a printed sheet set forth in (8), wherein the printer conducts primary scanning by a reciprocal movement of a printing head, secondary scanning is conducted by transporting a printed medium stepwise and the on-demand coating head is held on a movable table of an on-demanded printing head in an integral manner.

(14) A coating apparatus for a printed sheet set forth in (13), wherein the coating apparatus comprises: the on-demand printing head as an ink jet printing head; an ink vessel fixedly mounted to the printer body; a flexible tube extending from the ink vessel to the printing head; a cable guide for protecting and guiding interconnects and the tube by moving in a following manner with a reciprocal movement of the printing head, wherein the coating liquid vessel fixedly mounted to the printer body and the flexible tube connecting the vessel and the on-demand coating head are accommodated in the cable guide.

(15) A coating apparatus for a printed sheet set forth in (8), wherein the coating apparatus comprises plural coating heads used for different coating liquids on a support table, which supports the coating head, moving along a primary coating scanning direction.

(16) A coating apparatus for a printed sheet set forth in (8), wherein a coating head accepting one kind of coating liquid; scanning means; plural coating liquid vessels held by the printer body, which contains different coating liquids; a tube connecting between the vessels and the coating head; and a flow path switching means provided in a tube route.

(17) A coating apparatus for a printed sheet set forth in (16), wherein the coating apparatus comprises: a waste liquid receiver disposed at a position opposed to a home position of the coating head on the printed sheet side; and control means for continuous jetting of the coating liquid at a position of the coating head opposed to the waste liquid receiver.

(18) A coating apparatus for a printed sheet for applying a coating material in a liquid state on the surface of a printed medium, which comprises:

a page-wide coating head unit mounted so as to correspond to the maximum width of the printed medium along a direction perpendicular to a feed direction of the printed material; a coating head unit, in which an on-demand coating head is disposed so as to traverse the printed medium in a width direction in such a structure that the printed medium is divided in plural sections, wherein there is provided a structure in which control can be made with a section as a unit, said on-demand coating head having plural jet sections, jetting only liquid droplets limiting a direction from the respective jet sections by vibration of a high frequency vibrator element, and producing a coating area in the shape of a band extended in a direction perpendicular to the feed direction of the medium;

signal producing means for producing an edge position signal indicating an edge position of the printed medium along an arrangement direction of the sections; and control means for controlling the on-demand coating head of the page-wide coating head with a section as a unit based on the edge position signal and a signal indicating feed of the printed medium.

(19) A coating apparatus for a printed sheet set forth in (18), wherein the segmented coating head unit is constructed so that the segments are overlapped between adjacent segments at boundaries.

(20) A coating apparatus for a printed sheet set forth in (18), wherein the coating apparatus further comprises plural sets of coating head units applied for different coating liquids.

(21) A coating apparatus for a printed sheet set forth in (18), wherein the coating apparatus further comprises: a pair of coating units; plural coating vessels accommodating different coating liquids; tubes connecting the plural vessels with the pair of coating heads; and flow path switching means disposed in the tube route.

(22) A coating apparatus for a printed sheet set forth in (21), wherein the coating apparatus further comprises: a waste liquid receiver disposed at a position opposed the coating head unit on the printed medium side and control means which makes a coating liquid continuously jet from a coating head unit independently of feed of a printed medium.

The above structures have the following effects:

That is, according to the above mentioned structures (1), (8), (18), since a jetting direction of a coating liquid is controlled, there is applied a coating head with which not only is a coating area in the shape of a band formed, but also jetting can be arbitrarily controlled and jetting of a coating liquid is controlled by a signal indicating a coating area on a printed medium, coating is performed in a condition in which a coating liquid is not scattered outside a desired coating area and further the coating can automatically conducted.

According to the embodiments (8), (13), (18), since a coating head, scanning means and feed means for coating are provided in one body with a printer, coating can be conducted as a continuous process in an interlocking manner with a printing operation.

According to the embodiment (12), there is provided control means with which scanning and a jet rate of the coating head and the like can be controlled in response to a signal indicating a discharge speed of a printed medium from a printer. Therefore, in the case where a coating apparatus is integrally combined with a printer, even if a discharge speed of a printed medium from the printer is changed, coating can be kept at a constant coating thickness with the help of an automatic change in coating control corresponding to the change in the discharge speed.

According to structures of the embodiments (1), (8), (18), since coating control is conducted in response to a signal indicating an edge of a printed medium or an edge of an effective image area, even if a width of a printing medium is changed, a coating area is automatically restricted and thereby the coating is advanced without any trouble.

According to the embodiments (5), (6), (7), (15), (16), (17), (20), (21), (22) coating liquids of different kinds are held in a coating apparatus and a desired coating can be conducted among the coating liquids respectively made of different materials by switching coating liquids with selection of a corresponding coating head or with switching of flow paths based on a direction.

As has been described in detail, according to the present invention, there can be provided a coating apparatus for a printed sheet in which a coating liquid is prevented from scattering outside the surface of a printed sheet, a predetermined thickness can be secured following a feed rate of the printed medium, coating can freely be responded to a printed sheet whose width or the width of whose printed area is different in various ways and thereby a coating area can automatically be adjusted with ease, and coating materials with different actions and effects can selectively be used with ease and unnecessary consumption can be prevented.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A coating apparatus for a printed sheet in which a coating material in a liquid state is applied on a medium already printed, which comprises:

an on-demand coating head, which has a plurality of jet openings arranged in a direction parallel to left and right side edges of the printed medium, for producing a coating area having a width in the direction parallel to the left and right side edges of the printed medium by jetting out liquid droplets of the coating material through the jet openings in a direction substantially perpendicular to a face of the jet openings responsive to vibration of a piezoelectric element;

primary coating scanning means for reciprocating the on-demand head on the printed medium in a primary coating scanning direction which crosses the left and right side edges of the printed medium;

secondary coating scanning means for moving the on-demand coating head and the printed medium with respect to each other in a direction perpendicular to the primary coating scanning direction;

signal producing means for producing at least one of a first edge position signal indicating an effective image edge position of the printed medium with respect to the primary coating scanning direction and a second edge position signal indicating a printed medium edge position; and coating control means for controlling at least one of a liquid droplet jet from the on-demand coating head and a reciprocating movement of the on-demand coating head based on at least one of the first and second edge position signals.

2. A coating apparatus for a printed sheet according to claim 1, wherein the coating control means comprises means for controlling the on-demand coating head to be moved in a reciprocating manner to and from positions beyond the coating area, and means for controlling the liquid droplets of the coating material to be jetted only inside the coating area.

3. A coating apparatus for a printed sheet according to claim 1, wherein the coating apparatus comprises plural on-demand coating heads for applying different coating liquids.

4. A coating apparatus for a printed sheet in which a coating material in a liquid state is applied on a medium already printed, which comprises:

an on-demand coating head, which has a plurality of jet openings arranged in a direction parallel to left and right side edges of the printed medium, for producing a coating area having a width in the direction parallel to the left and right side edges of the printed medium by jetting out liquid droplets of the coating material through the jet openings in a direction substantially perpendicular to a face of the jet openings responsive to vibration of a piezoelectric element;

primary coating scanning means for reciprocating the on-demand head on the printed medium in a primary coating scanning direction which crosses the left and right side edges of the printed medium;

secondary coating scanning means for moving the on-demand coating head and the printed medium with respect to each other in a direction perpendicular to the primary coating scanning direction;

signal producing means for producing at least one of a first edge position signal indicating an effective image edge position of the printed medium with respect to the primary coating scanning direction and a second edge position signal indicating a printed medium edge position; and coating control means for controlling at least one of a liquid droplet jet from the on-demand coating head and a reciprocating movement of the on-demand coating head based on at least one of the first and second edge position signals wherein plural coating liquid vessels respectively containing different coating liquids are connected to said on-demand coating head, and a switch is provided for switching between flow paths from said plural coating liquid vessels and said on-demand coating head.

5. A coating apparatus for a printed sheet according to claim 4, wherein the coating apparatus further comprises a waste liquid receiver provided at a position opposed to the on-demand coating head on a printed sheet side, and wherein the coating control means includes means for controlling the on-demand coating head to continuously let the coating liquid at a position opposed to the waste liquid receiver.

6. A coating apparatus for a printed sheet, which comprises:

a printing head for forming an image onto a medium;

an on-demand coating head which is arranged downstream of the printing head with respect to a direction of transfer of the printed medium, said on-demand coating head having a plurality of jet openings arranged in a direction parallel to a discharging direction of the printed medium for producing a coating area having a width in a direction parallel to edges of the printed medium by jetting out liquid droplets of a coating material through the let openings in a predetermined direction responsive to vibration of a high frequency vibrator element;

primary coating scanning means for reciprocating the on-demand head on the medium in a primary coating scanning direction which crosses the edges of the printed medium, while traversing the printed medium;

signal producing means for producing at least one of a first edge position signal indicating an effective image edge position of the printed medium with respect to the primary coating scanning direction, and a second edge position signal indicating a printed medium edge position; and control means for controlling at least one of a liquid droplet jet from the on-demand coating head and a reciprocating movement of the on-demand coating head based on at least one of the first and second edge position signals.

7. A coating apparatus for a printed sheet according to claim 6, wherein the control means comprises means for controlling the on-demand coating head to be moved in a reciprocating manner to and from positions beyond the coating area, and means for controlling the liquid droplets of the coating material to be jetted only inside the coating area.

8. A coating apparatus for a printed sheet according to claim 6, wherein the coating apparatus further comprises means for sending out a signal indicating a discharge rate of a printed medium, and the control means comprises means for controlling at least one of the reciprocating movement of the on-demand coating head, ON/OFF of liquid droplet jet, and a jet rate of the liquid droplets.

9. A coating apparatus for a printed sheet according to claim 6, wherein the coating apparatus is operable with a printer which conducts primary scanning by the reciprocating movement of the printing head and which conducts secondary scanning by transporting the printed medium stepwise, and wherein the on-demand coating head is held on a movable table of the printer.

10. A coating apparatus for a printed sheet, which comprises:

a printing head for forming an image onto a medium;

an on-demand coating head which is arranged downstream of the printing head with respect to a direction of transfer of the medium, said on-demand coating head having a plurality of let openings arranged in a direction parallel to a discharging direction of the printed medium for producing a coating area having a width in a direction parallel to edges of the printed medium by jetting out liquid droplets of a coating material through the jet openings in a predetermined direction responsive to vibration of a high frequency vibrator element;

primary coating scanning means for reciprocating the on-demand head on the printed medium in a primary coating scanning direction which crosses the edges of the printed medium, while traversing the printed medium;

signal producing means for producing at least one of a first edge position signal indicating an effective image edge position of the printed medium with respect to the primary coating scanning direction, and a second edge position signal indicating a printed medium edge position; and control means for controlling at least one of a liquid droplet jet from the on-demand coating head and a reciprocating movement of the on-demand coating head based on at least one of the first and second edge position signals;

wherein the coating apparatus is operable with a printer which conducts primary scanning by the reciprocating movement of the printing head and which conducts secondary scanning by transporting the printed medium stepwise, and wherein the on-demand coating head is held on a movable table of the printer; and wherein an ink vessel is fixedly mounted to a body of the printer, a flexible tube extends from the ink vessel to the printing head, and a cable guide is provided for accommodating the flexible tube so as to protect and guide the flexible tube by moving in a following manner with the reciprocating movement of the printing head.

11. A coating apparatus for a printed sheet, which comprises:

a printing head for forming an image onto a medium;

an on-demand coating head which is arranged downstream of the printing head with respect to a direction of transfer of the medium, said on-demand coating head having a plurality of jet openings arranged in a direction parallel to a discharging direction of the printed medium for producing a coating area having a width in a direction parallel to edges of the printed medium by jetting out liquid droplets of a coating material through the jet openings in a predetermined direction responsive to vibration of a high frequency vibrator element;

primary coating scanning means for reciprocating the on-demand head on the printed medium in a primary coating scanning direction which crosses the edges of the printed medium, while traversing the printed medium;

signal producing means for producing at least one of a first edge position signal indicating an effective image edge position of the printed medium with respect to the primary coating scanning direction, and a second edge position signal indicating a printed medium edge position; and control means for controlling at least one of a liquid droplet jet from the on-demand coating head and a reciprocating movement of the on-demand coating head based on at least one of the first and second edge position signals;

wherein the coating apparatus comprises plural on-demand coating heads, used for respective different coating liquids, provided on a support table which moves along the primary coating scanning direction.

12. A coating apparatus for a printed sheet, which comprises:

a printing head for forming an image onto a medium;

an on-demand coating head which is arranged downstream of the printing head with respect to a direction of transfer of the medium, said on-demand coating head having a plurality of jet openings arranged in a direction parallel to a discharging direction of the printed medium for producing a coating area having a width in a direction parallel to edges of the printed medium by jetting out liquid droplets of a coating material through the jet openings in a predetermined direction responsive to vibration of a high frequency vibrator element;

primary coating scanning means for reciprocating the on-demand head on the printed medium in a primary coating scanning direction which crosses the edges of the printed medium, while traversing the printed medium;

signal producing means for producing at least one of a first edge position signal indicating an effective image edge position of the printed medium with respect to the primary coating scanning direction, and a second edge position signal indicating a printed medium edge position; and control means for controlling at least one of a liquid droplet jet from the on-demand coating head and a reciprocating movement of the on-demand coating head based on at least one of the first and second edge position signals;

wherein plural coating liquid vessels respectively containing different coating liquids are connected by a tube to the on-demand coating head, and a switch is provided in a tube route for switching between flow paths from said plural coating liquid vessels and the on-demand coating head.

13. A coating apparatus for a printed sheet according to claim 12, wherein the coating apparatus further comprises a waste liquid receiver disposed at a position opposed to a home position of the on-demand coating head on a printed sheet side, and wherein control means includes means for controlling the on-demand coating head to continuously jet the coating liquid at a position opposed to the waste liquid receiver.

14. A coating apparatus for a printed sheet for applying a coating material in a liquid state on a surface of a printed medium, which comprises:

a page-wide coating head unit including a plurality of on-demand coating heads aligned in a width direction of the printed medium, said on-demand coating heads each having a plurality of jet openings for jetting liquid droplets of the coating material through the jet openings in a predetermined direction by use of a piezoelectric element, wherein a region in which the coating material is to be jetted is divided into a plurality of sections in the width direction of the printed medium in such a manner that the on-demand coating heads are individually controllable in correspondence with each of the sections;

signal producing means for producing an edge position signal indicating an edge position of the printed medium along an arrangement direction of the sections; and control means for controlling the on-demand coating heads of the page-wide coating head unit in correspondence with each of the sections based on the edge position signal.

15. A coating apparatus for a printed sheet, which comprises:

a printing head for forming an image onto a medium;

an on-demand coating head arranged downstream of the printing head with respect to a direction of transfer of the medium, said on-demand coating head having a plurality of jet openings arranged in a direction parallel to a discharging direction of the printed medium for jetting out liquid droplets of a coating material through the jet openings in a predetermined direction responsive to vibration of a high frequency vibrator element;

a movable table on which the printing head and the on-demand coating head are mounted;

primary coating scanning means for reciprocating the movable table on the printed medium to traverse the printed medium, in a primary coating scanning direction which crosses edges of the printed medium;

secondary coating scanning means for moving the printed medium in a direction perpendicular to the primary coating scanning direction;

signal producing means for producing at least one of a first edge position signal indicating an effective image edge position of the printed medium with respect to the primary coating scanning direction and a second edge position signal indicating a printed medium edge position; and control means for controlling at least one of a liquid droplet jet from the on-demand coating head and a reciprocation movement of the movable table based on at least one of the first and second edge position signals.

* * * * *